US007009158B2

(12) United States Patent
Sekiguchi et al.

(10) Patent No.: US 7,009,158 B2
(45) Date of Patent: Mar. 7, 2006

(54) IMAGE FORMING APPARATUS

(75) Inventors: Hajime Sekiguchi, Kashiwa (JP); Yoshimitsu Nakane, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/787,079

(22) Filed: Feb. 27, 2004

(65) Prior Publication Data

US 2004/0206750 A1 Oct. 21, 2004

(30) Foreign Application Priority Data

Feb. 28, 2003 (JP) ..... 2003/053317
Mar. 7, 2003 (JP) ..... 2003/061728

(51) Int. Cl.
*H05B 6/14* (2006.01)

(52) U.S. Cl. ..... 219/619; 219/216; 399/328

(58) Field of Classification Search ..... 219/619, 219/216; 399/328–330, 333, 334, 335, 320, 399/45, 67, 70
See application file for complete search history.

(56) References Cited

U.S. PATENT DOCUMENTS 5,404,214 A * 4/1995 Yoshimoto et al. ..... 399/329
5,836,582 A 11/1998 Ogawa et al. ..... 271/12
6,453,144 B1 * 9/2002 Sato ..... 399/328
6,545,255 B1 4/2003 Sato et al. ..... 219/619
6,763,206 B1 * 7/2004 Kinouchi et al. ..... 399/70
2002/0175795 A1 11/2002 Fuseya et al. ..... 336/90
2003/0077093 A1 4/2003 Sekiguchi ..... 399/328
2003/0081961 A1 * 5/2003 Umezawa et al. ..... 399/67
2003/0086736 A1 5/2003 Sekiguchi et al. ..... 399/328

FOREIGN PATENT DOCUMENTS

JP 4-166966 6/1992
JP 5-9027 2/1993
JP 9-171889 6/1997
JP 10-74009 3/1998

* cited by examiner

*Primary Examiner*—Quang Van
(74) *Attorney, Agent, or Firm*—Fitzpatrick, Cella, Harper & Scinto

(57) ABSTRACT

A heating apparatus includes a heat generation member for generating heat using magnetic flux; a coil for generating the magnetic flux by electric power supply thereto, the coil being disposed in the heat generation member, wherein a material to be heated is fed and introduced in a heating portion of the heat generation member to heat an image on the material to be heated by heat generated by the heat generation member: a movable member which is movable in the heat generation member; a rotatable drive transmission member for transmitting a driving force to the movable member, wherein the drive transmission member has a hollow rotation shaft, and a supply line for supplying the electric power is connected to the coil through the hollow rotation shaft.

3 Claims, 14 Drawing Sheets

(a)

(b)

(c)

(a)

(b)

(c)

IMAGE FORMING APPARATUS

FIELD OF THE INVENTION AND RELATED ART

The present invention relates to a heating apparatus, in particular, of an electromagnetic (magnetic) induction type, preferably usable as an image fixing apparatus for fixing an unfixed image, with the use of the combination of heat and pressure, in an image data recording apparatus (image forming apparatus) such as a copying machine, a printer, a facsimileing machine, etc.

The present invention will be described with reference to an image heating apparatus mountable in an image forming apparatus, for example, an electrophotographic copying machine, a printer, a facsimileing machine, etc.

The image heating apparatus in an image forming apparatus is an apparatus for thermally and permanently fixing an unfixed toner image to the surface of recording medium. Here, an unfixed toner image means an image directly or indirectly (transfer) formed on the surface of recording medium as an object to be heated, with the use of toner (developing agent) formed of thermally meltable resin or the like, by an optional image forming processing means, for example, an electrophotographic or electrostatic recording process, in the image formation station of an image forming apparatus.

There are various thermal image fixing apparatuses in accordance with the prior art, for example, a fixing apparatus employing a single or plurality of rollers containing a heat source, a fixing apparatus employing an induction heating system, etc.

Generally, a heat roller type fixing apparatus comprises a pair of rotational rollers, more specifically, a fixation roller (heat roller), in which a heat source such as a halogen lamp is disposed, and the temperature of which is kept at a predetermined level, and a pressure roller. In operation, recording medium bearing an unfixed toner image is introduced into, and conveyed through, the contact nip (fixation nip) between the two rollers, so that the unfixed image on the recording medium is thermally fixed to the surface of the recording medium.

However, the amount of electrical power which this type of a thermal fixing apparatus requires for heating is rather large, because its fixation roller is rather large in thermal capacity. Therefore, this type of a thermal fixing apparatus is rather long in wait time (length of time it takes for apparatus to become ready for print output after apparatus is turned on), which is problematic. Further, in order to raise the temperature in the fixation nip formed by a fixation roller, which is rather large in thermal capacity, in a limited length of time, a large amount of electric power is necessary, which is also problematic.

As one of the measures commonly practiced to counter these problems is to reduce a fixation roller in thermal capacity by reducing the fixation roller in wall thickness. This measure, however, is problematic for the following reason. That is, if a fixation roller is reduced in wall thickness in order to reduce its thermal capacity, it is reduced in the thermal conduction in terms of its length direction (lengthwise direction of fixation nip). Therefore, as narrow recording medium is passed through the fixing apparatus, the portions of the roller(s) outside the recording medium track (path) excessively rises in temperature, reducing thereby the service life of the fixing roller and/or pressure roller.

One of the countermeasures to this problem is to employ halogen lamps as the heat source for a fixing apparatus. More specifically, a fixing apparatus is provided with a plurality of halogen lamps, which are different in the range, in terms of the lengthwise direction, across which light is emitted, and the timing with which they are turned on is tied to the width of the recording medium. Thus, the excessive temperature increase of the portions of the fixation nip, outside the recording medium track, is prevented by controlling the timing with which each of the plurality of halogen lamps is turned on. This measure, however, requires a measure for dealing with the high frequency flickering of the halogen lamps, because this measure requires the plurality of halogen lamps to be turned on and off to control the heat distribution in the fixation nip. One of the proposals for eliminating this flickering from a thermal fixing apparatus is to employ one of the induction heating systems, which has begun attracting attention in recent years. Next, a typical induction heating system will be described.

An induction heating system employs an induction heater as a heating member. In operation, an induction heating member is subjected to the magnetic field generated by a magnetic field generating means, inducing thereby eddy current in the induction heating member, which in turn generates the Joule heat in the induction heating member. This heat is applied to the recording medium, as an object to be heated, to fix the unfixed toner image on the recording medium to the surface of the recording medium.

Patent Document 1, given below, discloses a heat roller type thermal fixing apparatus, in accordance with the prior art, employing a ferromagnetic fixation roller in which heat can be generated by induction. With the employment of such a heat roller, heat can be generated near the fixation nip. Therefore, the heat roller type thermal fixing apparatus disclosed in Patent Document 1 is superior in thermal efficiency to a fixing apparatus employing a heat roller containing halogen lamps as heat sources.

However, the fixation roller which the fixing apparatus disclosed in Patent Document 1 employs the fixation roller, which is relatively large in thermal capacity. Therefore it is problematic in that it requires a relatively large amount of electric power in order to raise the temperature in the fixing nip within a limited length of time. One of the solutions to this problem is to reduce the fixation roller in thermal capacity, and one of the methods to reduce the fixation roller in thermal capacity is to reduce the fixation roller in wall thickness.

Patent Document 2 discloses a fixing apparatus employing an induction heating system, different from the one disclosed in Patent Document 1, which comprises a fixing member in the form of film which is much smaller in thermal capacity than a fixation roller.

This fixing apparatus also has a problem in that even a fixing member in the form of film, which is smaller in thermal capacity than a fixation roller, is employed, the portions of the fixation nip outside the recording medium track excessively increase in temperature, reducing thereby the service life of the fixation film and/or pressure roller.

Patent Documents 3 and 4 disclose a heating apparatus characterized in that it comprises a magnetic flux adjusting means capable of changing the distribution of the effective magnetic flux generated by the magnetic flux generating means, in terms of the widthwise direction of the fixation member (film). This type of induction heating system indicates one of the directions of the solution for eliminating the problem that the portions of the fixation nip outside the recording medium track excessively increase in temperature.

The fixing apparatuses in the aforementioned documents 3 and 4 disclose fixing apparatuses comprising a heating member, in the form of a piece of film, which generates heat by induction. According to these documents, it seems that using a cylindrical inductive heating member as a fixation roller is effective as a countermeasure to the excessive temperature increase across the portions of the fixation nip outside the recording medium track.

As the method, other than the aforementioned ones, for solving the problem of the excessive temperature increases across the portions of the fixation nip outside the recording medium track, there is a method in which fixation speed (throughput) is reduced when a recording medium of smaller (narrower) recording medium is passed. In this case, the reduction in fixation speed provides a longer time for the heat in the lengthwise end portions (portions outside recording medium track) of a fixation roller to conduct into the recording medium track portion of the fixation roller. This method, however, reduces the productivity of an image forming apparatus.

Document 1: Japanese Patent Application Publication 5-9027

Document 2: Japanese Laid-open Patent Application 4-166966

Document 3: Japanese Laid-open Patent Application 9-171889

Document 4: Japanese Laid-open Patent Application 10-74009.

As will be evident from the above descriptions, image fixing thermal apparatuses employing one of the well-known heating systems, more specifically, the heat roller type heating system and electromagnetic induction heating system, in accordance with the prior art, generally have the following problems.

A fixing apparatus, in accordance with the prior art, employing a single or plurality of rollers in which a single or plurality of halogen lamps are disposed as heat sources suffers from the following problems.

The lines feeding the halogen lamps with electrical power extend outward from both lengthwise ends of a fixation roller. Thus, in order to replace the fixation roller, it is necessary to uncouple two electrical joints at the lengthwise ends of the fixation roller, one for one. The joints also have to be uncoupled in order to replace the halogen lamps. Thus, the operation for replacing the fixation roller and/or halogen lamps cannot be completed from one side of the fixing roller.

Further, when assembling a fixing apparatus, the lines for feeding the halogen lamps with electrical power have to be inserted into the fixation roller, providing thereby the opportunity for the power feeding lines to become scratched and/or bent by coming into contact with the internal surface of the fixation roller.

These problems reduce the efficiency with which a fixing apparatus is assembled, as well as the efficiency with which a fixing apparatus is serviced, for example, when the structural components are replaced.

The fixing apparatuses, disclosed in the Patent Documents 3 and 4, which employ one of the induction heating systems in accordance with the prior art, as a countermeasure to the excessive temperature increase outside the recording medium track, also suffer from the problems similar to the above described ones.

In the case of a fixing apparatus employing an induction heating system in accordance with the prior art, the lines for feeding an exciter coil can be disposed at one of the lengthwise ends of the fixation roller. However, the relationship between the lines for feeding a magnetic flux adjusting means and the lines for feeding an excitation coil have not been shown in practical terms.

SUMMARY OF THE INVENTION

The present invention was made in consideration of the above described problematic points, and its primary object is to provide an electromagnetic induction type heating apparatus which comprises a magnetic flux adjusting means for dealing with the problem of excessive temperature increase outside the recording medium track, and which is superior to a heating apparatus in accordance with the prior art, in terms of the efficiency with which a heating apparatus can be assembled, the efficiency with which the structural components of a heating apparatus can be replaced, the space dedicated to the means for driving the magnetic flux adjusting means, the space dedicated to the excitation coil, and the interference between the means for driving the magnetic flux adjusting means and excitation coil.

An image forming apparatus for accomplishing the above objects comprising the following:

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

FIGS. 1–4 show an example of the electromagnetic induction type thermal fixing apparatus, as a heating apparatus, in accordance with the present invention.

Figure 1:
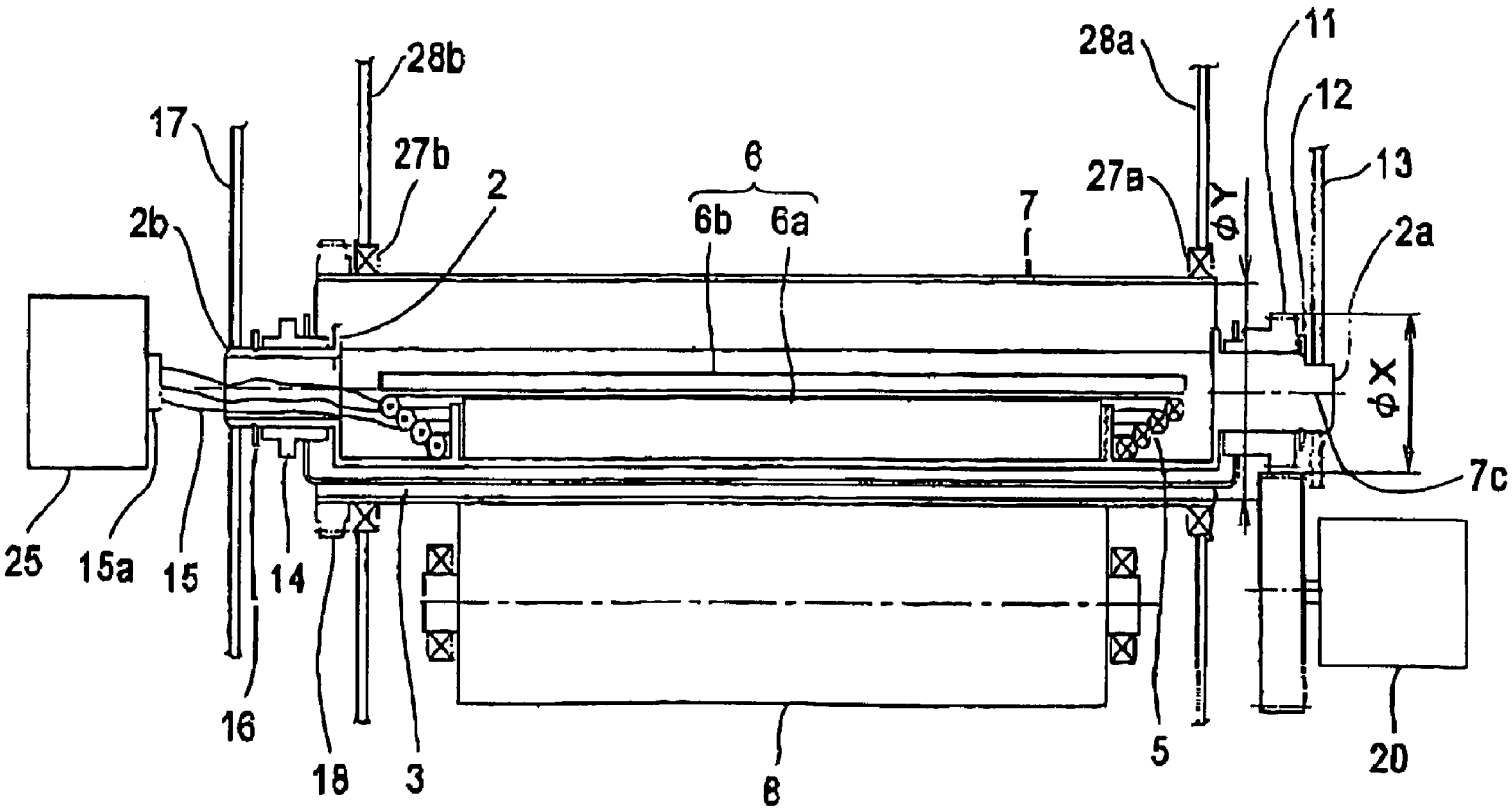
FIG. 1 is a schematic sectional view of the fixing apparatus in the first embodiment of the present invention, parallel to the lengthwise direction (axial direction) of the fixation roller, showing the general structure thereof.
Figure 2:
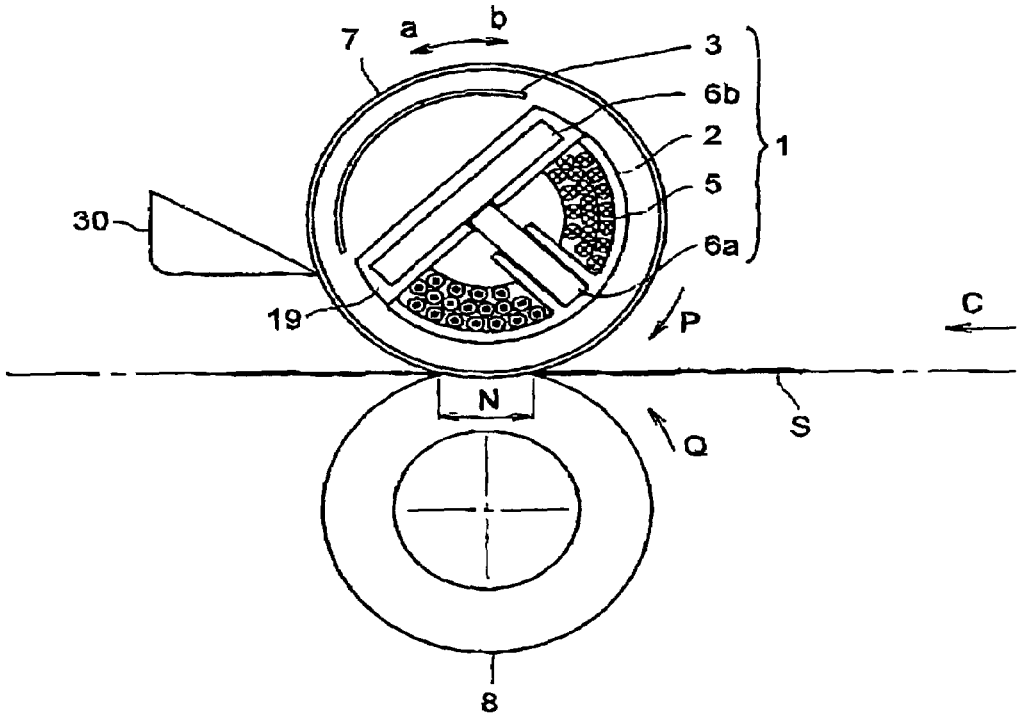
FIG. 2 is a schematic sectional view of the fixing apparatus in the first embodiment of the present invention, parallel to the diameter direction of the fixation roller, showing the general structure thereof.
Figure 3:
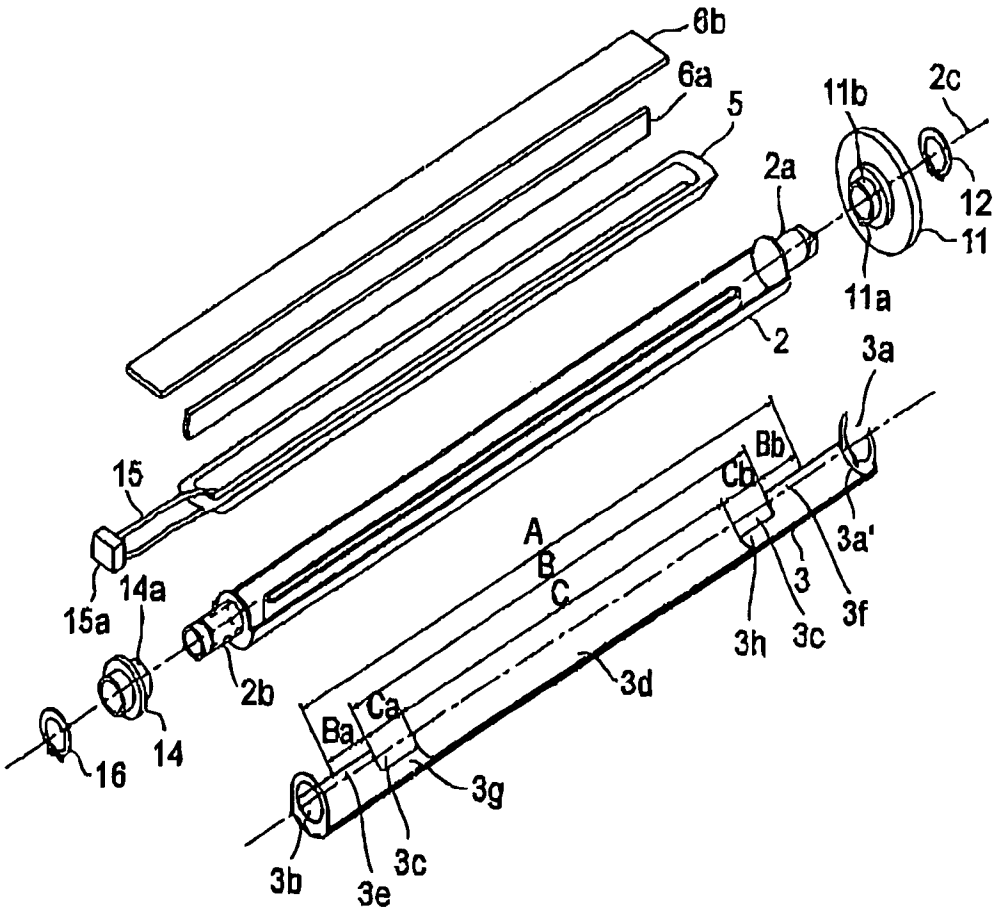
FIG. 3 is an exploded view of the magnetic flux adjustable heating assembly of the fixing apparatus in the first embodiment.

FIG. 1 is a schematic sectional view of the fixing apparatus in this embodiment, parallel to the lengthwise direction (axial direction) of the fixation roller, showing the general structure thereof. FIG. 2 is a schematic sectional view of the fixing apparatus in the first embodiment of the present invention, parallel to the diameter direction of the fixation roller, showing the general structure thereof. FIG. 3 is an exploded view of the magnetic flux adjustable heating assembly of the fixing apparatus in the first embodiment, showing the structures of the magnetic flux blocking member and magnetic flux generating means.

The fixing apparatus in this embodiment is presented as an example of a fixing apparatus in order to describe the relationship, between the magnetic flux blocking member gear, and fixation roller, for improving a fixing apparatus in terms of ease of maintenance, more specifically, the efficiency with which the components of the magnetic flux adjustable heating assembly can be serviced or replaced, as well as the efficiency with which a fixing apparatus can be assembled. The magnetic flux blocking member gear is a rotationally drivable member for driving the magnetic flux blocking member, and the fixation roller is an inductive heat generating member.

The fixing apparatus in this embodiment essentially comprises: a magnetic flux adjustable heating assembly 1, a fixation roller 7 as an inductive heating member, and a pressure roller 8.

The magnetic flux adjustable heating assembly 1, comprises: an excitation coil 5 (which hereinafter will be referred to simply as "coil") as a magnetic flux generating means, a magnetic core 6 (which hereinafter will be referred to as "core"), and a holder (holding member) 2 for holding the coil 5 and core 6, and a magnetic flux blocking member 3, as a magnetic flux adjusting means, having an arcuate cross section, rotatable in the counterclockwise or clockwise direction indicated by arrow marks a or b, respectively, about the lengthwise end portions of the holder 2.

The magnetic flux generating means comprises the coil 5, and the core 6 having a T-shaped cross section, disposed within the hollow of the fixation roller 7. The coil 5 and core 6 are held by the holder 2, and are covered with a holder cover 19.

The coil 5 is roughly elliptic (looking like a canoe positioned in parallel to the axial direction of the fixation roller 7), being elongated in the lengthwise direction of the fixation roller 7. It is disposed in the holder 2, in parallel to the internal surface of the fixation roller 7. The core 6 comprises a primary portion 6*a* (perpendicular portion) around which the coil 5 is wound, and the secondary portion 6*b* (horizontal portion) located above the primary portion 6*a*.

The coil 5 must be capable of generating alternating magnetic flux by an amount large enough to generate a sufficient amount of heat. In order for the coil 5 to generate a sufficient amount of alternating magnetic flux, the coil 5 must be high in inductance. The wire of the coil 5 is Litz wire, that is, a wire composed of roughly 80–160 strands of electrically insulated fine wires, the diameters of which are in the range of 0.1–0.3 mm, and which are bundled together. In the case of the coil 5, the Litz wire is wound 6–12 times around the primary core 6*a*. To the coil 5, an unshown excitation circuit is connected so that alternating current can be supplied to the coil 5 through the excitation circuit.

As the material for the core 6, such substances as ferrite and Permalloy that are high in permeability and low in residual flux density are desired. However, the choice does not need to be limited to these substances as long as magnetic flux can be generated. Further, the shape and material for the core 6 do not need to be limited to the above described ones. For example, the primary and secondary portions 6*a* and 6*b* or the core 6 may be integrally formed as a single-piece core 6, and such a construction can provide the same effects as the effects of the present invention which will be described next.

As the material for the cylindrical fixation roller 7 as an inductive heat generating member, such metals as iron, nickel, and cobalt that are ferromagnetic are desired, because the usage of ferromagnetic metal (metal higher in permeability) makes it possible to confine the magnetic flux generated by the magnetic flux generating means (combination of coil 5 and core 6) in the core 6, in other words, to make the core 6 higher in magnetic flux density. Therefore, eddy current is more efficiently induced at the surface of the ferromagnetic core (and therefore, in the surface portion of fixation roller 7), and therefore, heat is generated in the surface portion of the fixation roller 7 by a greater amount.

In order to optimize by reducing the thermal capacity of the fixation roller 7, the wall thickness of the fixation roller 7 is desired to be roughly in the range of 0.3–2 mm. The outer most layer of the fixation roller 7 is an unshown toner releasing layer, which generally is 10–50 $\mu$m thick film of PTFE, or PFA. The fixation roller 7 may be provided with a rubber layer, which is placed on the inward side of the toner releasing layer, in terms of the radius direction of the fixation roller 7.

The fixation roller 7 is provided with a fixation roller gear 18 attached to one of the lengthwise ends of the fixation roller 7. This gear is rotated by an unshown motor.

The pressure roller 8 comprises: a metallic core formed of iron; a silicone rubber layer formed on the peripheral surface of the metallic core; and a toner releasing layer formed on the peripheral surface of the silicon rubber layer. In other words, structurally, the pressure roller 8 is similar to the fixation roller 7.

The magnetic flux adjusting means of the fixing apparatus in this embodiment, extending in the lengthwise ends of the fixation roller, essentially comprises a magnetic flux blocking member 3, a holder 2, a magnetic flux blocking member gear 11, and a bushing 14. Among these structural components, the holder 2 and magnetic flux blocking member 3 are disposed within the hollow of the fixation roller 7.

The fixing apparatus in this embodiment is structured so that the magnetic flux blocking member 3 is rotated about the lengthwise end shafts of the holder 2, by which the holder which holds the coil 5 and core 6, is supported.

The lengthwise end portions of the holder 2 are shaped like an axle so that the magnetic flux blocking member 3 can be rotationally supported by the holder 2. In other words, not only does the holder 2 support the coil 5 and core 6, but also rotationally supports the magnetic flux blocking member 3.

The shaft 2*a* by which the holder 2 is supported on one side, is provided with a magnetic flux blocking member gear 11 for rotating the magnetic flux blocking member 3, whereas the shaft 2*b* by which the holder 2 is supported on the other side, is provided with the bushing 14 for making it easier for the magnetic flux blocking member 3 to slide. The holder support shafts 2*a* and 2*b* are provided with stopper rings 12 and 16, respectively, being thereby controlled in their movement in the thrust direction.

The holder 2 is formed of such a substance that is nonmagnetic, electrically insulating, and higher in heat resistance. For example, the holder 2 is formed of the combination of PPS resin and glass fiber added thereto, which has both heat resistance and mechanical strength, and obviously is nonmagnetic. If the holder 2 is formed of a magnetic substance, heat is generated in the holder 2 by electromagnetic induction, reducing thereby the efficiency with which heat is generated in the fixation roller by the magnetic flux generated by the coil 5.

As the substances suitable as the primary material for the holder 2, there are PPS resin, PEEK resin, polyimide resin, polyamide resin, polyamide-imide resin, ceramics, liquid crystal polymer, fluorinated resin, or the like.

The substances suitable as the material for the bushing 14 and magnetic flux blocking member gear 11 are basically the same as those for the holder 2; it is desired that one of the more slippery substances among the above listed resinous substances is chosen, for example, polyamide-imide resin, PFA resin, and PEEK resin.

The magnetic flux blocking member 3 is formed of such a substance that is nonmagnetic and is a good conductor of electricity. Forming the magnetic flux blocking member 3 of a nonmagnetic material is effective to block magnetic flux, and forming the magnetic flux blocking member 3 of a good conductor of electricity is effective to minimize the amount of the heat generated in the magnetic flux blocking member 3 itself by electromagnetic induction. In this embodiment, aluminum alloy is used as the material for the magnetic flux blocking member 3. However, the copper alloy, magnesium alloy, silver alloy, or the like may be used as the material for the magnetic flux blocking member 3.

The thickness of the magnetic flux blocking member has only to be roughly in the range of 0.3–1.0 mm. If it is no more than a value in this range, heat is generated in the magnetic flux blocking member 3 itself by electromagnetic induction; besides, the magnetic flux blocking member 3 will be insufficient in mechanical strength. On the other hand, if it is no less than a value in this range, the magnetic flux blocking member 3 will be large enough in thermal capacity to rob the fixation roller of a substantial amount of heat as heat is generated in the fixation roller, increasing thereby the aforementioned wait time.

Referring to FIG. 3, the magnetic flux blocking member 3 comprises a pair of magnetic flux blocking portions, which constitute the lengthwise end portions of the magnetic flux blocking member 3. Each magnetic flux blocking portion comprises fixation roller shielding portions 3*e* (3*f*) and 3*g* (3*h*), which are inside the track of the recording medium with a width A, and which correspond in position to the portions of the fixation roller (fixation nip) outside the track of the recording medium with a width B, and the track of the recording medium with a width C, respectively, creating a step between the fixation roller shielding portions 3*e* 3(*f*) and 3*g* (3*h*).

In other words, the magnetic flux blocking member 3 in this embodiment is provided with the pair of fixation roller shielding portions 3*e* and 3*f*, and the pair of fixation roller shielding portions 3*g* and 3*h*, having a step between the shielding portions 3*e* (3*f*) and 3*g* (3*h*).

On the holder shaft 2*a* side, the cylindrical portion 11*b* of the magnetic flux blocking member gear 11 fits in the hole of the C-shaped end portion of the magnetic flux blocking member 3; the projection 11*a* of the cylindrical portion 11*b* of the magnetic flux blocking member gear 11 fits into the U-shaped notch 3*a* of the C-shaped end portion of the magnetic flux blocking member 3. Therefore, as the magnetic flux blocking member gear 11 is rotated, the magnetic flux blocking member 3 is rotated in synchronism with the magnetic flux blocking member gear 11. To the magnetic flux blocking member gear 11, rotational force is given from a driving means 20. The driving means 20 has only to be a mechanical power source such as a motor. Incidentally, the present invention is not dependent upon the structure of the driving means 20. For example, the magnetic flux blocking member 3 may be rotated by a driving means comprising an actuator such as a solenoid, and a movement transmitting mechanism such as a mechanical linkage for transmitting the linear movement of the actuator to the magnetic flux blocking member gear 11 by converting the linear movement into rotational movement. Further, the magnetic flux blocking member gear 11 as the rotational force transmitting member may be replaced with a magnetic flux blocking member pulley such as the one in the third embodiment which will be described later. These modifications do not affect the effectiveness of the present invention.

The holder shaft 2*b* is shaped so that not only does it support the magnetic flux blocking member, but also it functions as the guide for the supply line 15 for supplying the coil 5 with electrical power. The holder supporting shaft 2*b* is rendered hollow, and the power supply line 15 is extended outward through the hollow of the holder supporting shaft 2*b*. The holder supporting shaft 2*b* is put through the hole 3*b* of the circular end of the magnetic flux blocking member 3, and the cylindrical portion of the bushing 14, being thereby rotationally supported. The outward end of the power supply line 15 is provided with a connector 15*a*, with which the power supply line 15 is connected to a power controlling apparatus 25. As the unshown excitation circuit is controlled by the power controlling apparatus 25, alternating current is supplied to the coil 5 through the power supply line 15.

The supporting shaft 2*a* of the holder 2 is supported by a holder supporting plate 13, and the supporting shaft 2*b* of the holder 2 is supported by the holder supporting plate 17. The portion of the supporting shaft 2*a*, by which the supporting shaft 2*a* is supported by the holder supporting member 13, is D-shaped in cross section (D-cut), and is fitted in the D-shaped hole of the holder supporting member 13, fixing thereby the position of the holder 2 in terms of the circumference direction of the fixation roller 7. With the provision of the above described structural arrangement, the holder 2 is positioned so that the rotational axis 7*c* of the fixation roller 7 (FIG. 1) coincides with the axial lines 2*c* of the holder supporting shaft 2*a* and 2*b* (FIG. 3).

Referring to FIG. 1, the external diameter øX of the magnetic flux blocking member gear 11 is smaller than the internal diameter øY of the fixation roller 7, satisfying the following inequality:

(external diameter øX of the magnetic flux blocking member gear 11)<(internal diameter øY of the fixation roller 7)

The above described structural arrangement makes it possible to assemble or service (which will be described later) the heating apparatus in this embodiment from the direction of the power supply line 15 (supporting shaft 2*b* side of the holder) of the coil 5.

Next, referring to FIGS. 1 and 8, an example of an assembly sequence for the fixing apparatus in this embodiment will be described.

Figure 8:
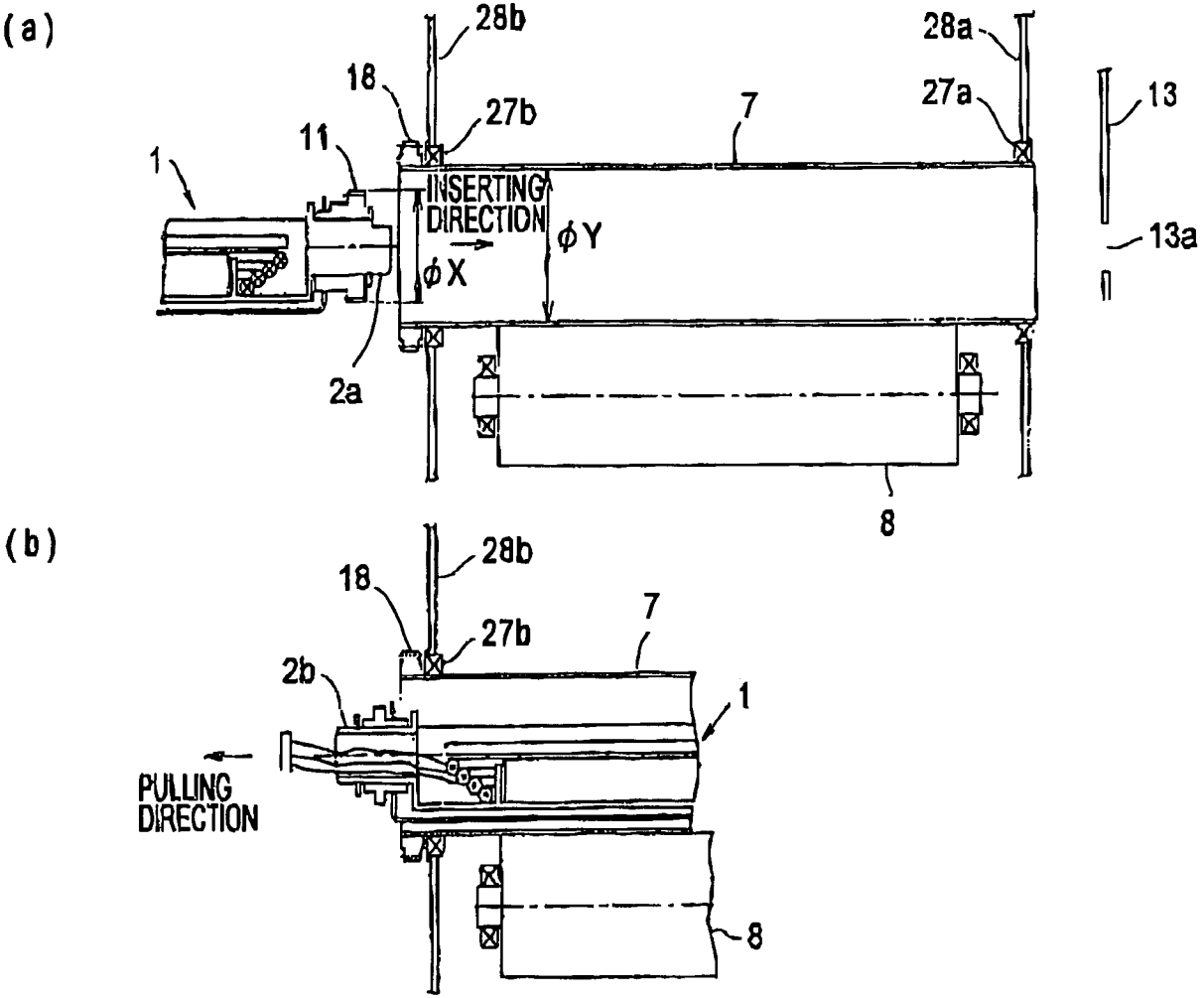
FIG. 8 is a schematic drawing showing the sequential steps for assembling or disassembling the fixing apparatus in the first embodiment of the present invention.

Referring to FIG. 8(*a*), first, the fixation roller 7 is to be supported by the fixation roller supporting plates 28*a* and 28*b*, with the interposition of bearings 27*a* and 27*b*, respectively. Then, a fixation roller gear 18 is attached to one of the lengthwise ends of the fixation roller 7, that is, the end fitted with the bearing 27*b*. Then, the same end of the fixation roller 7 is fitted with an unshown thrust control member to control the movement of the fixation roller 7 in the thrust direction. Up to this point, the assembly sequence is the same as that for a fixing apparatus in accordance with the prior art.

Next, the magnetic flux adjustable heating assembly 1 is inserted into the fixation roller 7, from one end of the fixation roller 7 (bearing 27*b* side), from the magnetic flux blocking member gear 11 side, so that the other end of the magnetic flux adjustable heating assembly 1 will stick out of the other end of the fixation roller 7 (bearing 27*a* side). Then, the holder supporting shaft 2*a* is fitted into the hole 13*a* of the holder supporting plate 13.

Next, the holder supporting shaft 2*b* (which is hollow and serves as guide for power supply line 15), shown in FIG. 1, is fitted with the holder supporting member 17. Then, the power supply line 15 is connected to the power controlling apparatus 25; the connector 15*a* of the power supply line 15 is connected to the power controlling apparatus 25, completing the placement of the magnetic flux adjustable heating assembly 1 into the fixation roller 7.

As described above, in the case of the fixating apparatus having the structure in this embodiment, it can be assembled without putting the power supplying line 15 directly through the fixation roller 7. Therefore, the problems that the power supply line 15 is scratched, bent, and/or stressed during the assembly of the fixing apparatus do not occur. Further, the assembly sequence for the fixing apparatus can be carried out from one end of the fixation roller 7 (fixation roller bear 18 side). Therefore, the fixing apparatus can be more efficiently assembled.

Next, the sequence to be carried out to disassemble the fixing apparatus in this embodiment, for example, when replacing the fixation roller 7, magnetic flux generating means, etc., will be described.

When replacing a component of the fixing apparatus, the components of the fixing apparatus are to be removed in the order opposite to the order in which they are attached. First, referring to FIG. 1, the power supply line 15 is disconnected from the power controlling apparatus 25, at one of the lengthwise ends of the fixation roller 7. Next, the holder supporting member 17 is separated from the holder supporting shaft 2*b*. Lastly, the magnetic flux adjustable heating assembly 1 is pulled out from within the fixation roller 7, from the holder supporting shaft 2*b* side, as shown in FIG. 8(*b*), and removed.

As described above, in this embodiment, all the operations for servicing the fixing apparatus, for example, replacing a single or plurality of components thereof, can be performed from one end of the fixation roller 7. Therefore, the fixing apparatus can be more efficiently serviced compared to a fixing apparatus in accordance with the prior art. In other words, the fixing apparatus in this embodiment can be assembled or disassembled without putting, or pulling, the power supply line 15 through the fixation roller 7. Therefore, the power supply coil 5 is not scratched, bent, and/or stressed during assembling or disassembling the fixing apparatus, in particular, assembling the fixing apparatus.

Also in this embodiment, the fixing apparatus is structured to satisfy this inequality: (external diameter øX of the magnetic flux blocking member gear 11)<(internal diameter øY of the fixation roller 7), so that the holder 2 for holding the magnetic flux generating means (combination of coil 5 and core 6) and magnetic flux blocking member 3 can be assembled into a compact unit. Therefore, the combination of the fixation roller 7 and magnetic flux generating means can be more efficiently assembled or serviced (their components can be replaced) compared to that in accordance with the prior art.

In the case of the fixing apparatus in this embodiment, the magnetic flux blocking member 3 is rotated in a predetermined direction by the driving means 20, by an angle proportional to paper (recording medium) size, so that the shield portions 3*e* and 3*f*, and the shield portions 3*g* and 3*h* shield the portions of the fixation roller 7 outside the recording medium track. With these shielding portions of the magnetic flux blocking member 3 shielding the portions of the fixation roller 7 outside the recording medium track, the magnetic flux is prevented from reaching the shielded portions of the fixation roller 7, or the portions outside the recording medium track, reducing the amount by which heat is generated in the fielded portions, or the lengthwise end portions, of the fixation roller 7. Therefore, the portions of the fixation roller 7 outside the recording medium track do not excessively increase in temperature.

In this embodiment, the magnetic flux blocking member 3 can be set at three positions: width A (maximum size) position at which no part of the fixation nip excessively increases in temperature; width B (intermediary size) position; and width C (smallest size) position, in order to change the size of the range, in terms of the lengthwise direction of the fixation roller 7, across which heat is generated in the fixation roller 7 by electromagnetic induction. For example, when recording medium (paper) width is A, B, or C, which is equivalent to A4 (297 mm), B4 (257 mm), or A4R (210 mm) width in the metric system, the distance between the pair of shielding portions of the magnetic flux blocking member 3 can be adjusted according to the recording medium (paper) width by rotating the magnetic flux blocking member 3. The recording medium (paper) width (size) is determined according to the specifications of the image forming apparatus in which a fixing apparatus is mounted. The number of the fixation roller shielding portions of the magnetic flux blocking member 3 does not need to be two; it can be increased or reduced depending on the number of widths in which the recording media which will be fed to a fixing apparatus are available. It may be one, or three or more, in order to prevent the portions of the fixation nip outside the recording medium track from excessively rising.

Also in this embodiment, the fixing apparatus comprises: the coil 5; core 6; holder 2 for holding the coil 5 and core 6; magnetic flux blocking member 3. One of the lengthwise ends of the magnetic flux blocking member 3 is supported by the holder supporting shaft 2*a,* and the other is supported by the holder supporting shaft 2*b,* as described above. In other words, the holder 2 and magnetic flux blocking member 3 are integrally assembled into a compact unit.

Further, in this embodiment, the axial lines 2*c* (FIG. 3) of the holder supporting shafts 2*a* and 2*b* by which the magnetic flux blocking member 3 is supported coincide with the rotational axis 7*c* (FIG. 1) of the fixation roller 7. Therefore, the magnetic flux blocking member 3 can be disposed within the fixation roller 7, with the interposition of the magnetic flux blocking member gear 11 and bushing 14 fitted around the holder supporting shafts 2*a* and 2*b*, respectively, making it unnecessary to secure a space for the magnetic flux blocking member 3, on the outward side of the fixation roller 7, along the peripheral surface of the fixation roller 7. Therefore, it is possible to reduce the size of a fixing apparatus.

Further, in this embodiment, the holder 2 for holding magnetic flux generating means (combination of coil 5 and core 6) and magnetic flux blocking member 3 are integrally assembled into a compact unit, improving not only the efficiency with which they are assembled, but also the efficiency with which the fixing apparatus can be serviced, for example, when the fixation roller 7 is replaced during maintenance.

Further, the magnetic flux blocking member 3 can be rotationally driven about the rotational axis 7*c* of the fixation roller 7, by the driving means 20 located at one of the lengthwise ends of the fixation roller 7 (supporting shaft 2*a* side of the holder 2). Therefore, the space for the driving means 20 has only to be provided on the supporting shaft 2*a* side of the holder 2, making it possible to reduce the fixing apparatus dimension in terms of the thrust direction of the fixation roller 7.

Also in the case of the fixing apparatus in this embodiment, the fixation nip (heating nip) N having a predetermined width is formed between the fixation roller 7 and pressure roller 8, by placing the pressure roller 3, and the fixation roller 7 internally holding the above described assembly 1 into the unshown housing of the fixing apparatus so that the fixation roller 7 is kept vertically pressed on the pressure roller 8 from above, as shown in FIGS. 1 and 2.

The fixation roller 7 is rotated in the clockwise direction indicated by an arrow mark F by the fixation roller gear 18, causing the pressure roller 8 to be rotated in the counterclockwise direction indicated by an arrow mark Q by the rotation of the fixation roller 7.

The coil 5 is made to generate alternating magnetic flux, by the alternating current supplied to the coil 5 from the power controlling apparatus 25. The alternating magnetic flux is guided by the core 6 to the fixation nip N, inducing eddy current in the surface portion of the fixation roller 7, in the fixation nip N. The eddy current generates Joule heat in the surface portion of the fixation roller 7 because of the resistivity of the surface portion of the fixation roller 7. In other words, as the coil 5 is supplied with alternating current, heat is generated by electromagnetic induction, in the fixation roller 7, in the fixation nip N.

The temperature in the fixation nip N is kept at a predetermined level suitable for fixation, by the temperature controlling system, inclusive of an unshown temperature sensor, which controls the alternating current supplied to the coil 5 from the power controlling apparatus 25.

In operation, the fixation roller 7 is rotated by the rotation of the fixation roller gear 18, and alternating current is supplied to the coil 5 from the power controlling apparatus 25 to raise the temperature in the fixation nip N to the predetermined level. After the temperature of the fixation nip N reaches the predetermined level, the recording medium (paper) S bearing an unfixed toner image is inserted into the fixation nip N between the fixation roller 7 and pressure roller 8, along the recording medium path H (indicated by single-dot chain line) from the direction indicated by an arrow mark C, being thereby conveyed through the fixation nip N. While the recording medium S is conveyed through the fixation nip N, the recording medium S and unfixed toner image are heated by the heat generated in the fixation roller 7. As a result, the toner image is fixed to the recording medium. After being conveyed through the fixation nip N, the recording medium S is separated from the peripheral surface of the fixation roller 7, on the exit side of the fixation nip N, and is conveyed further.

Next, referring to FIG. 4 which is a schematic sectional view of the fixing apparatus and magnetic circuit in this embodiment, the function and movement of the magnetic flux blocking member 3 of the fixing apparatus in this embodiment will be described.

In the drawing, the magnetic flux Ja (represented by double-dot chain line) is a part of the magnetic circuit of the magnetic flux generated by the magnetic flux generating means as electric power (alternating current) is inputted into the magnetic flux generating means from the power controlling apparatus. The magnetic flux Ja passes through the primary portion 6*a* (perpendicular portion) of the core 6, fixation roller 7, and secondary portion 6*b* (horizontal portion) of the core 6. In reality, the magnetic flux passes the inward side of the fixation roller 7 higher in permeability. However, for ease of description, the line Ja is drawn as is in FIG. 4.

At this time, the areas of the fixation roller 7, in which heat is generated by electromagnetic induction, will be discussed.

It is thought that in terms of the amount of heat generated in the fixation roller 7, the portions of the fixation roller 7 next to the coil 5 are the largest for the following reason. That is, magnetic flux is generated so that it shuttles through the primary and secondary portions 6*a* and 6*b* of the core 6*a*. Therefore, the magnetic flux density is higher in the portions of the fixation roller 7 next to the coil 5. In consideration of this concept, the magnetic flux generating means (combination of coil 5 and core 6) is slightly tilted so that heat will be generated in the portion of the fixation roller 7 in contact with the pressure roller 8, and the portion of the fixation roller 7 on the immediately upstream side of the fixation nip N in terms of the rotational direction of the fixation roller 7. Further, as the fixation roller 7 is rotated, it is uniformly heated.

The magnetic flux generating means is provided to generate heat based on the principle of electromagnetic induction heating. In the case of the magnetic flux adjusting means, the width of the path, through which the magnetic flux shuttles in the fixation roller, is adjusted by the magnetic flux blocking member 3 in order to control the amount by which heat is generated in the lengthwise end portions of the fixation roller 7, by electromagnetic induction.

More specifically, the amount by which heat is generated in the fixation roller 7 can be efficiently reduced by the placement of the magnetic flux blocking member 3 between the core 6 and fixation roller 7; if the core 6 is T-shaped in cross section, shielding the fixation roller 7 from the primary portion (perpendicular portion) 6*a* of the core 6 is particularly effective to reduce the amount. As will be evident from the magnetic circuit Ja in FIG. 4(*a*), the primary portion 6*a* of the core 6 is higher in magnetic flux density than the secondary core 6*b* (horizontal portion), and the magnetic flux separates into two portions at the outward end (edge) of the portion 6*a* and the joint between the portions 6*a* and 6*b*. Therefore, it is more effective to shield the fixation roller 7 from the magnetic flux, across this portion of the magnetic circuit, that is, across the area corresponding to the outer end (edge) of the core 6*a*.

Figure 4:
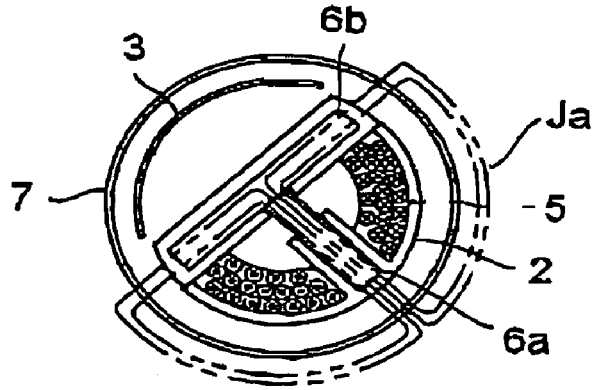
FIG. 4 is a schematic drawing showing the magnetic circuit when the magnetic flux is blocked by the magnetic flux blocking member in the fixing apparatus in the first embodiment.
Figure 4:
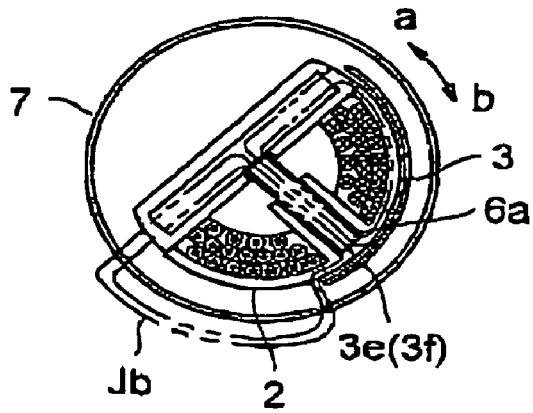
Figure 4:
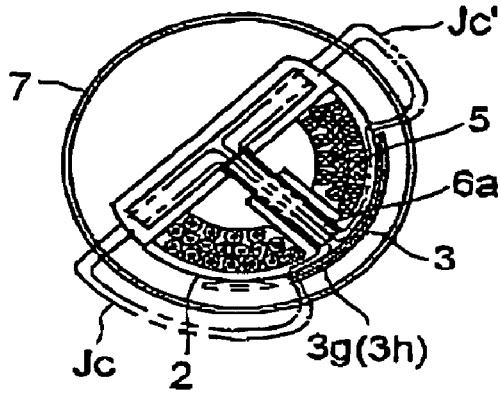

Referring to FIG. 4(*a*), when recording medium of the width A, which does not cause any excessive temperature increase in the portions of the fixation nip N outside the recording medium track, is used, the magnetic flux blocking member 3 is kept on standby in the area in which it has little effect on the magnetic circuit Ja. In FIG. 4(*a*), the magnetic flux blocking member 3 is on standby in the area where the magnetic circuit Ja is not present. When the magnetic flux blocking member 3 is positioned as shown in FIG. 4(*a*), it does not affect the magnetic circuit Ja. Therefore, heat is generated in the fixation roller 7 by electromagnetic induction, across its entire range, which corresponds to the width A of recording medium, enabling the entirety of the fixation nip N to heat the recording medium for fixation.

Referring to FIG. 4(*b*), when recording medium of the width B, which is capable of excessively increasing the portions of the fixation nip outside the recording medium track, the magnetic flux blocking member 3 is rotated into the position in which it interferes with the magnetic circuit Ja, preventing the magnetic flux from reaching the portion of the fixation roller 7 behind the magnetic flux blocking member 3. In FIG. 4(*b*), the fixation roller shielding portions 3*e* and 3*f* of the magnetic flux blocking member 3 cover the corresponding portions of the primary portion 6*a* of the core 6, blocking the flow of the magnetic flux flowing into, or out of, these portions of the portion 6*a*. The magnetic circuit Jb shown in the drawing is such a magnetic circuit that is formed in the range Ba (Bb), corresponding to the shielding portions 3*e* (3*f*) (FIG. 3). As will be evident from the drawing, when recording medium of the width B is fed, the amount of the magnetic flux which passes through the fixation roller 7, in the range Ba (Bb), corresponding to shielding portion 3*e* (3*f*), which is outside the recording medium track, is smaller compared to the amount shown in FIG. 4(*a*). Therefore, the amount by which heat is generated by electromagnetic induction, in the portions of the fixation roller 7, corresponding to the shielding portions 3*e* and 3*f* having the widths of Ba and Bb, respectively, is smaller. Therefore, the portions of the fixation nip outside the recording medium track do not excessively increase. In this case, the center portion of the fixation nip, the dimension of which, in terms of the lengthwise direction of the fixation nip, matches the recording medium width B, becomes the range in which the fixation by electromagnetic induction is possible.

When recording medium with the width C, which causes the excessive temperature increase in the portions of the fixation nip outside the recording medium track, is used, the relationship among the recording medium width, fixation roller shielding portions of the magnetic flux blocking member 3, and range in which the fixation by electromagnetic induction is possible, is similar to that when the recording medium is of the width B. That is, the magnetic flux blocking member 3 is further rotated into the magnetic circuit Ja. In the drawing, the shielding portion 3*g* (3*h*) of the magnetic flux blocking member 3 is positioned between the primary portion 6*a* of the core 6 and the fixation roller 7 to interfere with the flow of the magnetic flux. The magnetic circuits Jc and Jc' in the drawing are the results of the deformation caused by the interference from the shielding portions 3*g* and 3*h* having the widths of Ca and Cb, respectively (FIG. 3). When recording medium with the width C is in use, the portion of the magnetic circuit, which corresponds to the portions of the fixation roller 7 shielded from the coil 5 by the shielding portions 3*e* and 3*f* with the widths Ba and Bb, and shielding portions 3*g* and 3*h* with the widths Ca and Cb, that is, the portions of the fixation roller 7 corresponding to the portions of the fixation nip outside the recording medium track, become the combination of magnetic circuits Jb, Jc and Jc' in FIGS. 4(*b*) and 4(*c*). In other words, the portions of the magnetic flux, which go through the fixation roller, within the above described ranges (Ba+Ca) and (Bb+Cb) are smaller than the portion of the magnetic flux which goes through the fixation roller 7 in the ranges Ba and Bb in FIG. 4(*a*). Therefore, the amount by which heat is generated by electromagnetic induction, in the ranges (Ba+Ca) and (Bb+Cb) is smaller, being prevented from excessively increasing the portion or the fixation nip outside the recording medium track. In this case, the center portion of the fixation nip, which corresponds to the distance 3*d* between the two fixation roller shielding portions of the magnetic flux blocking member 3, and the width of which equals the recording medium width C is the range in which fixation by electromagnetic induction is possible.

Embodiment 2

Next, referring to FIG. 6, the second embodiment of the present invention will be described.

The components, such as the magnetic flux generating means (5 and 6), fixation roller 7, pressure roller 8, etc., of the image forming apparatus in this embodiment are the same as those in the first embodiment. The components in this embodiment which are the same in function as those in the first embodiment are given the same referential symbols as those given in the first embodiment. Further, the substances used as the material for the magnetic flux blocking member 3 are the same as those used in the first embodiment.

In the second embodiment, the inequality: (external diameter øX of the magnetic flux blocking member gear 11)< (internal diameter øY of the fixation roller 7), which is mandatory in the first embodiment, is not mandatory. In other words, this embodiment is different from the first embodiment in that the external diameter øX of the magnetic flux blocking member gear 11 may be greater than the internal diameter øY of the fixation roller 7.

In the second embodiment, the holder supporting shaft 2*a* is shaped so that it can function as the guide for the power supply line 15 which supplies the coil 5 with electric power. The holder supporting shaft 2*a* is made hollow so that the power supply line 15 can be extended outward through the holder supporting shaft 2*a*. The magnetic flux blocking member gear 11 is rotatably filled around the holder supporting shaft 2*a*. Thus, the power supply line 15 can put through the magnetic flux blocking member gear 11 (holder supporting shaft 2*a*), and connected to the power controlling apparatus 25 with the use of the connector 15*a*, to supply the coil 5 with electric power.

The holder 2 is supported by the holder supporting plate 13 and the holder supporting member 17, on the supporting shaft 2*a* and 2*b* sides, respectively. The portion of the supporting shaft 2*a,* by which the supporting shaft 2*a* is supported by the holder supporting member 13, is D-shaped in cross section (D-cut), and is fitted in the D-shaped hole of the holder supporting member 13, fixing thereby the position of the holder 2 in terms of the circumference direction of the fixation roller 7.

In the second embodiment, the tip 2*b*T of the holder supporting shaft 2*b* is tapered so that the holder supporting shaft 2*b* can be smoothly inserted into the D-shaped hole 17*a* of the holder supporting plate 17 when the magnetic flux adjustable heating assembly 1 is put together. Obviously, the same effect can be obtained by tapering the tip of the holder supporting shaft 2*a,* in the first embodiment, through which the power supplying line 15 is put.

Next, referring to FIGS. 6 and 9, an example of an assembly sequence for the fixing apparatus in this embodiment will be described.

Figure 9:
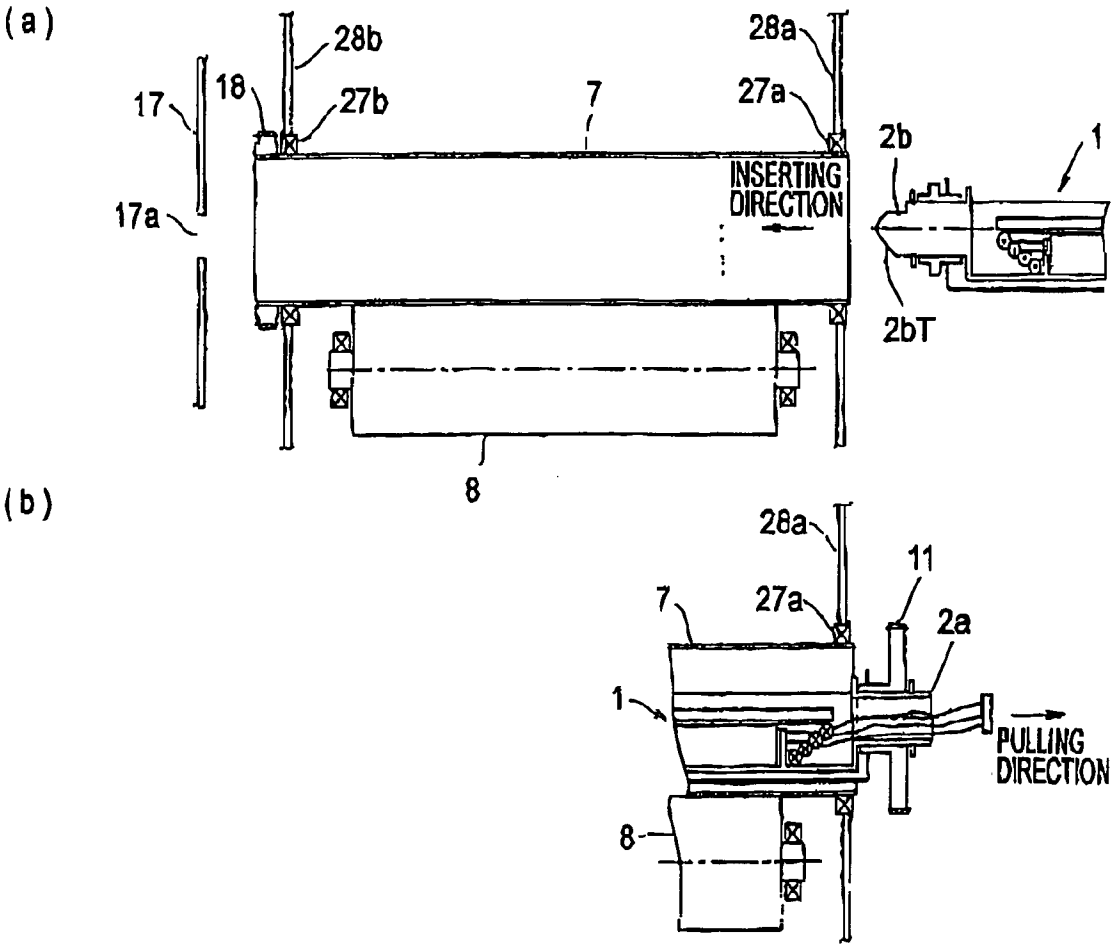
FIG. 9 is a schematic drawing showing the sequential steps for assembling or disassembling the fixing apparatus in the second embodiment of the present invention.

Referring to FIG. 9(*a*), first, the fixation roller 7 is to be supported by the fixation roller supporting plates 28*a* and 28*b,* with the interposition of bearings 27*a* and 27*b,* respectively. Then, a fixation roller gear 18 is attached to one of the lengthwise ends of the fixation roller 7, that is, the end fitted with the bearing 27*b.* Then, the same end of the fixation roller 7 is fitted with an unshown thrust control member to control the movement of the fixation roller 7 in the thrust direction. Up to this point, the assembly sequence is the same as that for a fixing apparatus in accordance with the prior art.

Next, the magnetic flux adjustable heating assembly 1 is inserted into the fixation roller 7, from one end of the fixation roller 7 (bearing 27*a* side), from the tapered end 2*b*T side of the holder supporting shaft 2*b,* so that the other end of the magnetic flux adjustable heating assembly 1 will stick out of the other end of the fixation roller 7 (bearing 27*b* side). Then, the holder supporting shaft 2*a*, having the tapered tip 2*b*T, is fitted into the D-shaped hole 17*a* of the holder supporting plate 17.

Figure 6:
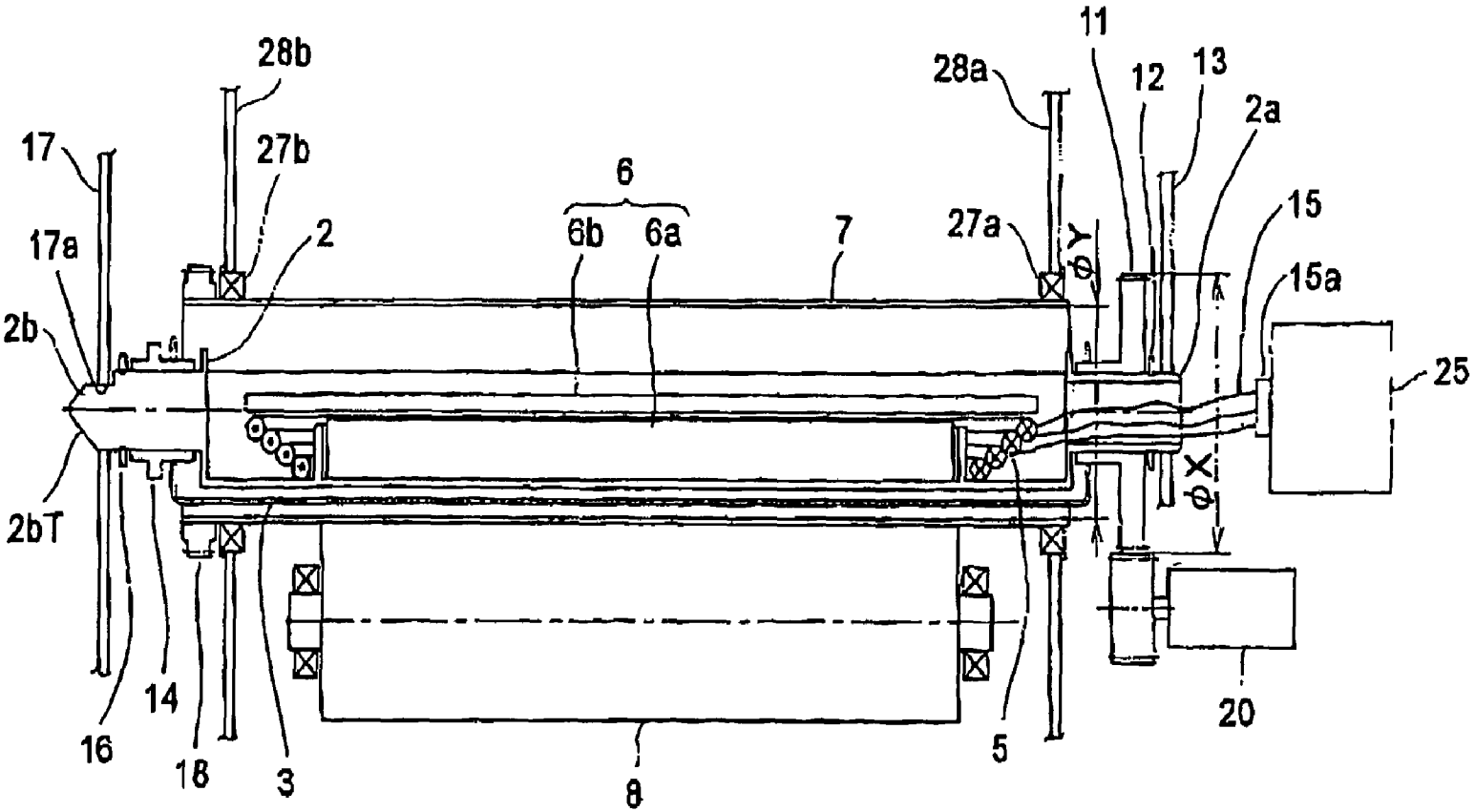
FIG. 6 is a schematic sectional view of the fixing apparatus in the second embodiment of the present invention parallel to the lengthwise direction of the fixation roller, showing the general structure thereof.

Next, the holder supporting shaft 2*a* (which is hollow and serves as guide for power supply line 15), shown in FIG. 6, is fitted with the holder supporting member 13. Then, the power supply line 15 is connected to the power controlling apparatus 25; the connector 15*a* of the power supply line 15 is connected to the power controlling apparatus 25, completing the magnetic flux adjustable heating assembly 1.

As described above, in the case of the fixing apparatus structured as in this embodiment, it can be assembled without putting the power supplying line 15 through the fixation roller 7. Therefore, the problems that the power supply line 15 is scratched, bent, and/or stressed during the assembly of the magnetic flux adjustable heating assembly 1 do not occur. Further, the assembly sequence for the magnetic flux adjustable heating assembly 1 can be carried out from one end of the fixation roller 7 (side opposite to fixation roller bear 18). Therefore, the magnetic flux adjustable heating assembly 1 can be more efficiently assembled.

In the second embodiment, there is no requirement regarding the relationship between the internal diameter øY of the fixation roller 7 and the external diameter øX of the magnetic flux blocking member gear 11 (because the magnetic flux adjustable heating assembly 1 is inserted into the fixation roller 7 from the holder supporting shaft 2*b* side), affording greater latitude in apparatus design, which is meritorious. Further, the magnetic flux adjustable heating assembly is structured so that the magnetic flux blocking member gear 11 does not need to be put through the hollow of the fixation roller 7. Therefore, the magnetic flux blocking member gear 11 is prevented from sustaining such damage as scratches and indentations.

Next, the sequence to be carried out to disassemble the fixing apparatus in this embodiment, for example, when replacing the fixation roller 7, magnetic flux generating means, etc., will be described.

When replacing the components of the fixing apparatus, they are to be removed in the order opposite to the order in which they are attached. First, the power supply line 15 shown in FIG. 6 is disconnected from the power controlling apparatus 25, at one of the lengthwise ends of the fixation roller 7. Next, the holder supporting member 13 is separated from the holder supporting shaft 2*a*. Lastly, the magnetic flux adjustable heating assembly 1 is pulled out from within the fixation roller 7, from the holder supporting shaft 2*a* side, as shown in FIG. 9(*b*), and removed.

As described above, in this embodiment, all the steps for servicing the fixing apparatus, for example, replacing a single or plurality of components thereof, can be performed from one end of the fixation roller 7. Therefore, the fixing apparatus can be more efficiently serviced compared to a fixing apparatus in accordance with the prior art. More specifically, the magnetic flux adjustable heating assembly 1 in this embodiment can be assembled or disassembled without putting, or pulling, the power supply line 15 directly through the fixation roller 7. Therefore, the power supply coil 5 is not scratched, bent, and/or stressed during assembling or disassembling the fixing apparatus, in particular, assembling the fixing apparatus.

Further, in the second embodiment, the magnetic flux adjustable heating assembly 1 is structured so that the power supply line 15 for the coil 5 of the magnetic flux adjustable heating assembly 1 can be put through the magnetic flux blocking member gear 11, and so that the top 2*b*T of the holder supporting shaft 2*b,* which is on the side opposite to the side where the magnetic flux blocking member gear 11 is, is tapered. In addition, the holder 2 for holding magnetic flux generating means (combination of coil 5 and core 6) and magnetic flux blocking member 3 are integrally assembled into a compact unit. Therefore, not only is the fixing apparatus in this embodiment better in the efficiency with which the fixation roller 7, magnetic flux generating member, etc., are assembled, but also the efficiency with which the fixing apparatus can be serviced, for example, when the fixation roller 7, the magnetic flux generating member, etc., are replaced.

Embodiment 3

Figure 7:
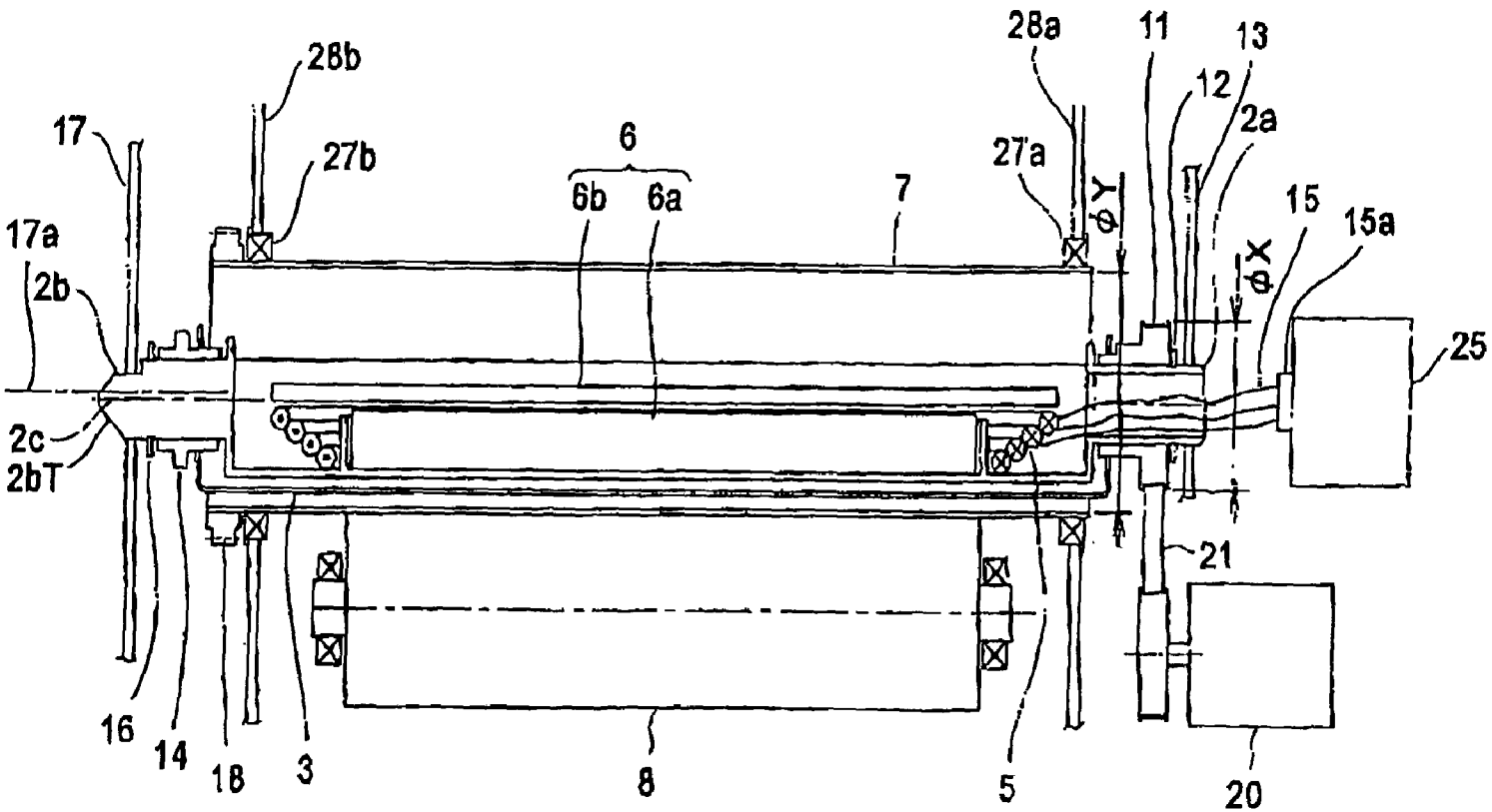
FIG. 7 is a schematic sectional view of the fixing apparatus in the third embodiment of the present invention, parallel to the lengthwise direction of the fixation roller, showing the general structure thereof.

Next, referring to FIG. 7, the fixing apparatus in the third embodiment of the present invention will be described.

The components, such as the magnetic flux generating means (5 and 6), fixation roller 7, pressure roller 8, etc., of the image forming apparatus in this embodiment are the same as those in the first embodiment. The components in this embodiment which are the same in function as those in the first embodiment are given the same referential symbols as those given in the first embodiment. Further, the substances used as the materials for the magnetic flux blocking member 3 are the same as those used in the first embodiment.

In the third embodiment, in the place of the magnetic flux blocking member gear 11 in the first embodiment, a magnetic flux blocking member pulley 11 is provided, and a belt 21 is wrapped around the pulley 11 and the pulley 20*a* of the driving means 20. Further, the third embodiment is similar to the first embodiment in that the external diameter øX of the magnetic flux blocking member pulley 11 is smaller than the internal diameter øY of the fixation roller 7:

(external diameter øX of the magnetic flux blocking member pulley 11)<(internal diameter øY of the fixation roller 7).

Also in the third embodiment, the tip 2*b*T of the holder supporting shaft 2*b* is tapered as in the second embodiment.

In this embodiment, however, the size of the fixation roller 7 in terms of the circumferential direction is made greater than that in the preceding embodiments, and the magnetic flux adjustable heating assembly 1 is structured so the axial line of the fixation roller 7 does not coincide with those of the holder supporting shafts 2*a* and 2*b,* about which the magnetic flux blocking member 3 is rotated. In other words, in terms of the cross section of the magnetic flux adjustable heating assembly 1, the rotational axis of the fixation roller 7 is offset from the rotational axis 2*c* of the magnetic flux blocking member 3.

There are two choices of sequences for assembling the fixing apparatus, and two choices of sequences for disassembling the fixing apparatus in order to servicing the fixing apparatus, for example, replacing the components thereof. One of the assembly or disassembly sequences makes good use of the relationship between the external diameter øX of the magnetic flux blocking member pulley 11 and the internal diameter øY of the fixation roller 7, being therefore virtually the same as that in the first embodiment. The other of the assembly or disassembly sequences makes good use of the tapered tip 2*b*T of the holder supporting shaft 2*b,* being therefore virtually the same as that in the second embodiment. It is optional which of the two assembly or disassembly sequences is to be chosen; it may be determined based on the position of the cover of an image forming apparatus for mounting or dismounting a fixing apparatus.

The structural arrangement, in this embodiment, for the magnetic flux adjustable heating assembly 1 makes it possible for the fixation roller 7 with a larger diameter to be used with the magnetic flux adjustable heating assembly 1 for a fixation roller with a smaller diameter, making it thereby possible to make some of the components of the magnetic flux adjustable heating assembly 1 interchangeable. Therefore, the number of molds can be reduced. In other words, this structural arrangement makes it possible to reduce the cost of a fixing apparatus.

Obviously, it can be easily deduced from the third embodiment that a plurality of magnetic flux adjustable heating assemblies 1 can be disposed in a single fixation roller with a diameter greater than that of the fixation roller 7 in this embodiment.

As described above, according to each of the above described embodiments, the fixing apparatus (magnetic flux adjustable heating assembly 1) can be assembled without putting the power supply line 15 directly through the fixation roller 7. Therefore, the problem that the power supply line 15 is scratched, bent, and/or stressed while the fixing apparatus (magnetic flux adjustable heating assembly 1) is assembled does not occur. Further, the magnetic flux adjustable heating assembly 1 can be serviced from one side of the fixation roller 7, in terms of the lengthwise direction of the fixation roller 7; for example, the components of the magnetic flux adjustable heating assembly 1 can be replaced from one side of the fixation roller 7. Therefore, the fixing apparatus can be serviced more efficiently than a fixing apparatus in accordance with the prior art. Further, with the provision of the above described structural arrangement, the fixing apparatus (magnetic flux adjustable heating assembly 1) can be assembled or disassembled without putting or pulling the power supply line 15 through the fixation roller. Therefore, the fixing apparatus in this embodiment is superior in assembly efficiency and component replacement efficiency to a fixing apparatus in accordance with the prior art.

Embodiment 4

Next, referring to FIGS. 10, 11, and 12, the fourth embodiment of the present invention will be described.

The fixing apparatus in this embodiment is structured so that the magnetic flux is adjustable by rotating the magnetic flux generating means around the stationarily disposed magnetic flux adjusting means (magnetic flux blocking member). The components, such as the magnetic flux generating means, fixation roller, pressure roller, etc., of the image forming apparatus in this embodiment are the same as those in the first embodiment. The components in this embodiment which are the same in function as those in the first embodiment are given the same referential symbols as those given in the first embodiment. Further, the substances used as the materials for the magnetic flux blocking member 3 are the same as those used in the first embodiment.

Figure 10:
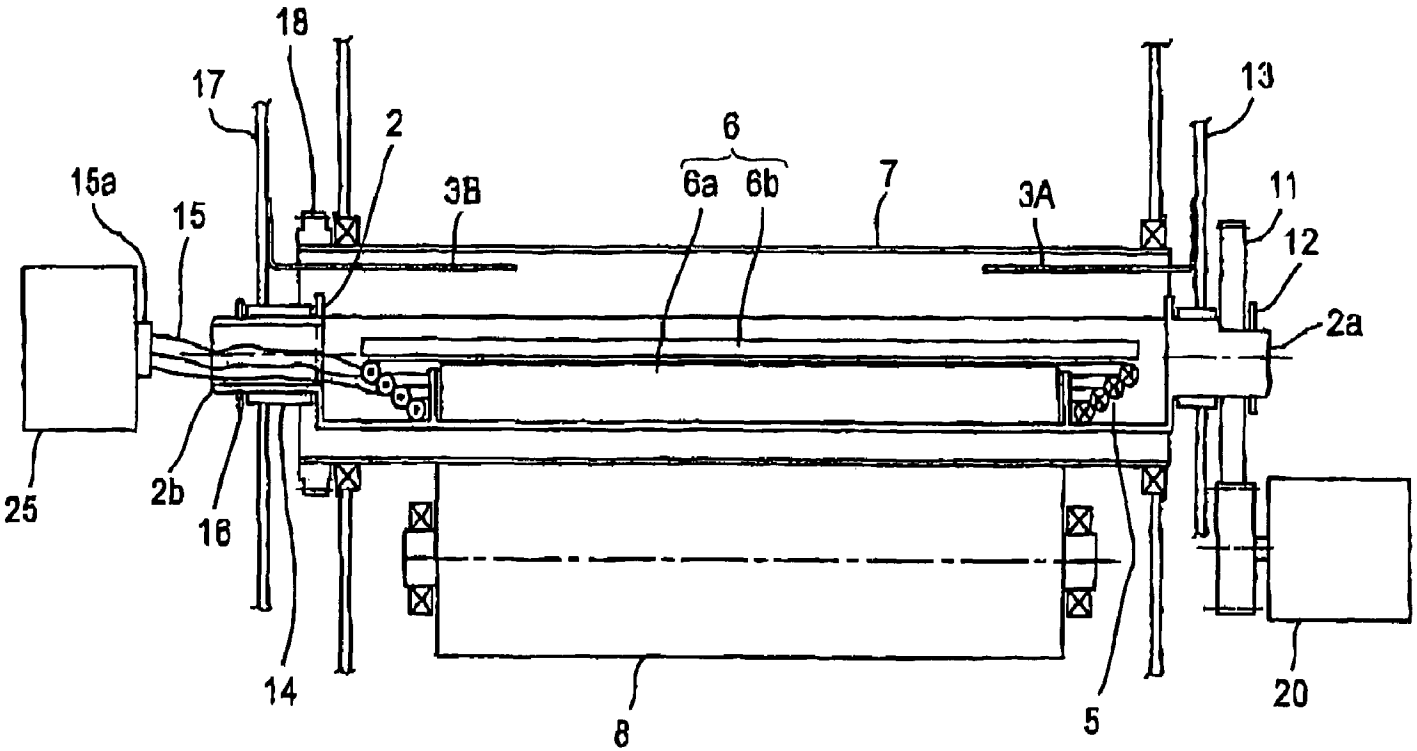
FIG. 10 is a schematic sectional view of the fixing apparatus in the fourth embodiment of the present invention, parallel to the lengthwise direction of the fixation roller, showing the general structure thereof.

The magnetic flux blocking member in this embodiment is different from that in the first embodiment in that the former is formed of two components 3A and 3B (FIG. 10). Referring to FIG. 12, the magnetic flux blocking members 3A and 3B are arcuate, and have two sections distinctively different in dimensions. The shapes and dimensions of these two sections will be described later. The magnetic flux blocking members 3A and 3B are solidly attached to the holder supporting plate 13 and 17, which are on the supporting shafts 2*a* and 2*b* sides of the holder 2, respectively, with the use of unshown small screws.

In the fixing apparatus in this embodiment, the holder 2 which is supporting the combination of the coil 5 and core 6, as the magnetic flux generating means, is rotated about the rotational axes of the supporting shafts 2*a* and 2*b,* by the magnetic flux blocking member gear 11; the portion of the holder supporting shaft 2*a,* which is D-shaped in cross section, is fitted in the D-shaped (D-cut) hole of the magnetic flux blocking member gear 11 so that driving force can be transmitted to the holder supporting shaft 2*a.* With the provision of this structural arrangement, the holder 2 can be rotated in the direction indicated by an arrow mark a, or arrow mark b.

Figure 12:
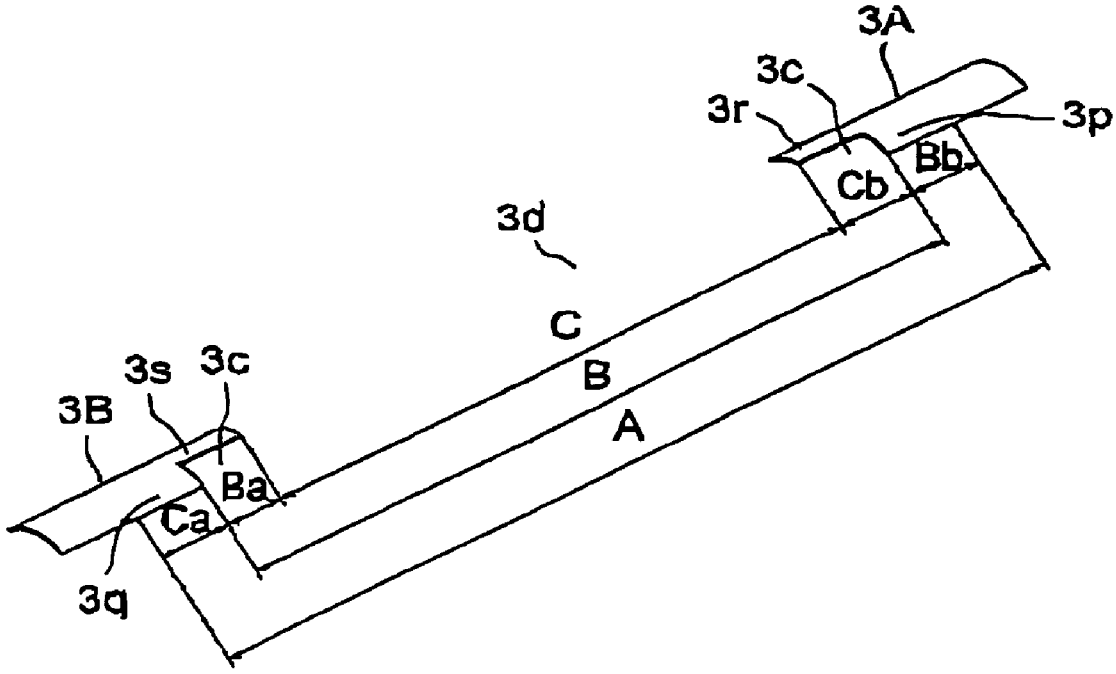
FIG. 12 is a perspective view of the magnetic flux blocking member in the fixing apparatus in the forth embodiment of the present invention.

Referring to FIG. 12, the magnetic flux blocking member 3A has fixation roller shielding portions (corresponding to portions of fixation nip outside recording medium track) 3*p* and 3*r,* and the magnetic flux blocking member 3B has fixation roller shielding portions 3*q* and 3*s*. The shielding portions 3*p* and 3*q* are identical in shape and size, and are greater in dimension in terms of the circumferential direction of the fixation roller 7, than the shielding portions 3*r* and 3*s* which are identical in shape and size. In other words, these fixation roller shielding portions 3*p* (3*q*) and 3*r* (3*s*) correspond to the fixation roller shielding portions 3*g* (3*h*) and 3*e* (3*f*), in the first embodiment, which are different in dimension in terms of the circumferential direction of the fixation roller 7. Therefore, there is a step between the shielding portion 3*p* (3*q*) and shielding portion 3*g* (3*h*).

In other words, the fixation roller shielding portions of the magnetic flux blocking members 3A and 3B are the combination of the fixation roller shielding portions 3*p* and 3*r,* and the combination of the 3*q* and 3*s,* respectively. The portion 3*p* (3*q*) is greater in dimension in terms of the circumferential direction of the fixation roller 7 than the portion 3*r* (3*s*). In order to prevent the abnormal temperature increase in the portions of the fixation nip outside the recording medium track, by reducing the amount by which heat is generated in the portions of the fixation roller 7 outside the recording medium track in terms of the axial direction of the fixation roller 7, the holder 2 is rotated by the driving means 20, by an angle which matches the recording medium size, so that the fixation roller shielding portions 3*p* and 3*g*, or the combination of the shielding portions 3*p* and 3*r* and the combination of the shielding portions 3*q* and 3*s*, are rotated to position the core 6*a* integral with the holder 2, on the opposite side of the fixation roller shielding portions 3*p* and 3*g*, or the combination of the shielding portions 3*p* and 3*r* and the combination of the shielding portions 3*q* and 3*s*, in order to shield the fixation roller 7 from the magnetic flux from the core 6*a*, by these shielding portions.

With the provision of the above described magnetic flux blocking members 3A and 3B, the magnetic flux can be adjusted in three widths, in terms of the axial direction of the fixation roller 7: width matching the recording medium width A (maximum size) which does not cause the excessive temperature increase in the portions of the fixation nip outside the recording medium track; width matching the recording medium width B, which is smaller than the recording medium size A; and width matching the recording medium width C, which is smaller than the recording medium width B. When recording medium size is stated in the metric system, the recording medium widths A, B, and C in the standard system are A4 (297 mm), B4 (257 mm), and A4R (210 mm). In this case, the distance between the fixation roller shielding portions 3*r* and 3*s* and the distance between the fixation roller shielding portions 3*p* and 3*q*, in terms of the axial direction of the fixation roller 7, are adjusted so that the three ranges in terms of the lengthwise direction of the fixation roller 7, across which the fixation roller 7 is not shielded by the fixation roller shielding portions, match the three recording medium widths A, B, and C. The values of these distances are to be set in accordance with the specifications of the image forming apparatus in which the fixing apparatus is mounted. The number of the fixation roller shielding portions of the magnetic flux blocking member does not need to be limited to two. It may be increased or reduced in accordance with the number of the widths in which the recording media usable with a given image forming apparatus are available. However, when the number of the widths in which the recording media usable with a given image forming apparatus are available, and which requires the fixation roller 7 to be partially shielded is only one, the magnetic flux blocking member does not need to have two shielding portions different in size.

Figure 11:
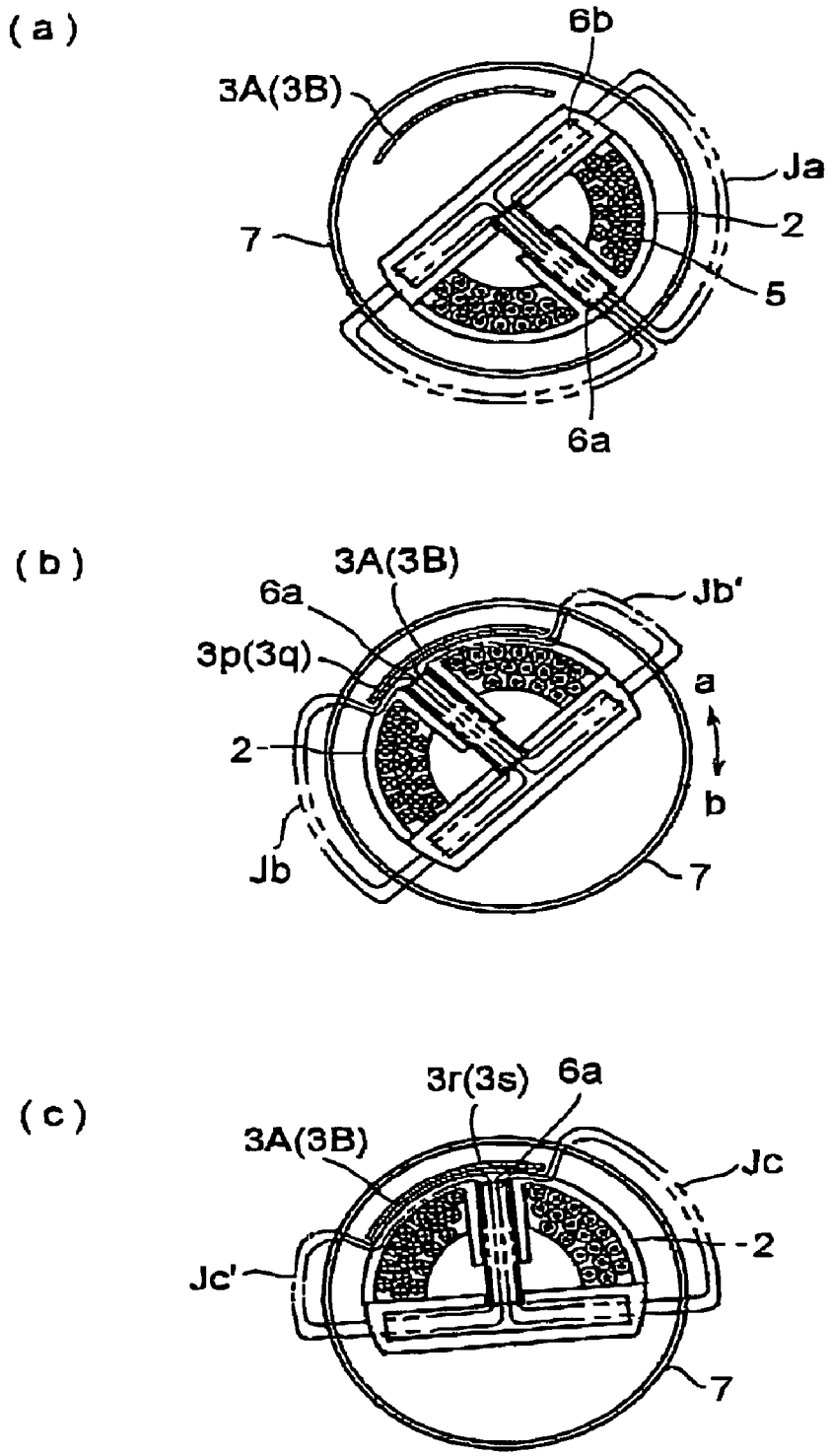
FIG. 11 is a schematic drawing showing the magnetic circuit when the magnetic flux is blocked by the magnetic flux blocking member in the fixing apparatus in the fourth embodiment of the present invention.

When the width of recording medium used in an image forming apparatus is A, which does not cause the excessive temperature increase in the portions of the fixation nip outside the recording medium track, the relationship between the magnetic flux blocking member 3A (or 3B) and the holder 2 holding the coil 5 and core 6 is as shown in FIG. 11(*a*). In other words, the holder 2 is positioned in the range in which the magnetic circuit Ja is not affected by the magnetic flux blocking member 3A (or 3B). When the holder 2 is in this position, magnetic flux blocking member 3A (or 3B) does not affect the magnetic circuit Ja. Therefore, the fixation by electromagnetic induction can be possible across the entire range of the fixation nip which corresponds the recording medium width A.

When the recording medium with the width B which causes the excessive temperature increases in the fixation nip outside the recording medium track, is used, the holder 2 holding the coil 5 and core 6 is rotated so that the magnetic flux blocking members are placed in the positions in which the magnetic flux blocking members block the flow of the magnetic flux. In the drawing, the fixation roller shielding portions 3*p* and 3*q* of the magnetic flux blocking members 3A and 3B are between the portion 6*a* of the core 6 and the fixation roller 7, blocking thereby the flow of the magnetic flux. Designated by referential symbols Jb and Jb' are the magnetic circuits when the magnetic flux is impeded by the fixation roller shielding portions 3*p* and 3*q*, by the width of Ba and Bb, respectively (FIG. 12). As will be evident from the drawing, the portions of the magnetic flux which goes through the portions of the fixation roller 7 outside the recording medium track and shielded by the fixation roller shielding portions 3*p* and 3*q* having the widths of Ba and Bb, respectively, are smaller than that those shown in FIG. 11(*a*). Thus, the amount by which heat is generated in these portions of the fixation roller 7 by electromagnetic induction is smaller, and therefore, these portions of the fixation roller 7 do not excessively increase in temperature. In this case, the center portion of the fixation nip, the width of which equals the recording medium width B (range between the inward edges of the fixation roller shielding portions 3*p* and 3*q* perpendicular to the axial direction of the fixation roller 7) is where the fixation by electromagnetic induction is possible.

The operation of the magnetic flux adjustable heating assembly 1 when the recording medium with the width C, which causes the excessive temperature increase in the portions of the fixation nip outside the recording medium track, is used is similar to that when the recording medium with the width B is used. That is, the holder 2 holding the coil 5 and core 6 are further rotated in order to cause the primary portion 6*a* of the core 6 to face the fixation roller shielding portions 3*r* and 3*s* of the magnetic flux blocking members 3A and 3B, as shown in the drawing, so that the flow of the magnetic flux is impeded by the shielding portions 3*r* and 3*s*. The referential symbols Jc and Jc' designate the portions of the magnetic circuits from the portions of the core 6 covered by the shielding portions 3*r* and 3*s* having the widths of Ca and Cb. The referential symbols Jb, Jb', Jc, and Jc' in FIGS. 11(*b*) and 11(*c*) designate the portions of the magnetic flux which go through the portions of the fixation roller 7 outside the track of the recording medium with the width of C and shielded from the portion 6*a* of the core 6 by the combination of the shielding portions 3*p* and 3*r*, having a total width of (Ba+Ca), and the combination of 3*q* and 3*s*, having a total width of (Bb+Cb) (FIG. 11). As will be evident from the drawing, the portions of the magnetic flux which go through the fixation roller shielded from the primary portion 6*a* of the core 6 by the combination of the shielding portions 3*q* and 3*s*, having the width of (Ba+Ca), and the combination of the shielding portions 3*p* and 3*r*, having the width of (Bb+Cb), is smaller than that in FIG. 11(*a*). In other words, the amount by which heat is generated in these portions of the fixation roller 7, having the widths of (Ba+Ca) and (Bb+Cb), respectively, by electromagnetic induction is smaller, and therefore, these portions do not excessively increase in temperature. In this case, the center portion of the fixation nip, the width of which equals to the recording medium width C (range between the inward edges of the fixation roller shielding portions 3*r* and 3*s* perpendicular to the axial direction of the fixation roller 7) is where the fixation by electromagnetic induction is possible.

Embodiment 5

Figure 13:
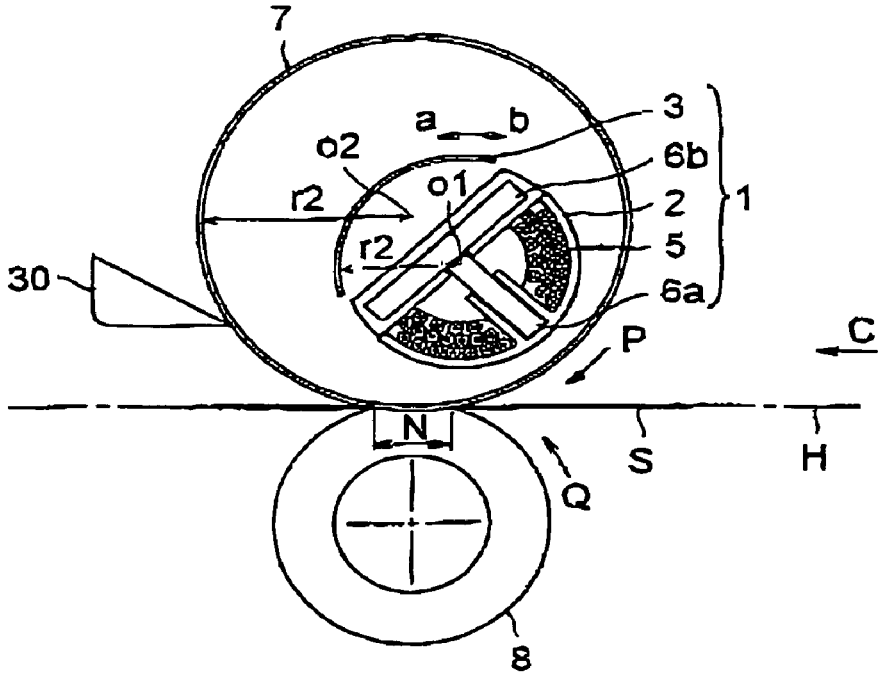
FIG. 13 is a schematic sectional view of the fixing apparatus in the fifth embodiment of the present invention, parallel to the diameter direction of the fixation roller, showing the general structure thereof.

Next, referring to FIG. 13, the fixing apparatus in the fifth embodiment of the present invention will be described.

The fixing apparatus in this embodiment is an example of a fixing apparatus in which the magnetic flux adjustable heating assembly 1 in the first embodiment is placed in a fixation roller 7, the radius r2 of which is twice the rotational radius r1 of the magnetic flux blocking member 3 (r1<r2). In this embodiment, the axial line of the fixation roller does not coincide with the rotational axis of the magnetic flux blocking member 3. In other words, the rotational axis o1 of the magnetic flux blocking member 3 is offset from the rotational axis of the fixation roller 7. The components, such as the magnetic flux generating means 5 and 6, pressure roller 8, etc., of the image forming apparatus in this embodiment are the same as those in the first embodiment. The components in this embodiment which are the same in function as those in the first embodiment are given the same referential symbols as those given in the first embodiment. Further, the substances used as the materials for the holder 2 and magnetic flux blocking member 3 are the same as those used in the first embodiment.

In the case of the fixing apparatus in this embodiment, the effects similar to those obtained by the first embodiment are obtained by rotating the magnetic flux blocking member 3 in the direction indicated by an arrow mark a or b, relative to the assembly 1, within the fixation roller 7.

The structural arrangement, in this embodiment, for the magnetic flux adjustable heating assembly 1 makes it possible for the fixation roller 7 with a larger diameter to be used with the magnetic flux adjustable heating assembly 1 for a fixation roller with a smaller diameter, making it thereby possible to make some of the components of the magnetic flux adjustable heating assembly 1 interchangeable. Therefore, the number of molds can be reduced. Thus, this structural arrangement makes it possible to reduce the cost of a fixing apparatus.

Obviously, it can be easily deduced from the fifth embodiment that a plurality of magnetic flux adjustable heating assemblies 1 can be disposed in a single fixation roller.

Embodiment 6

Next, referring to FIGS. 14 and 15, the sixth embodiment of the present invention will be described.

Figure 14:
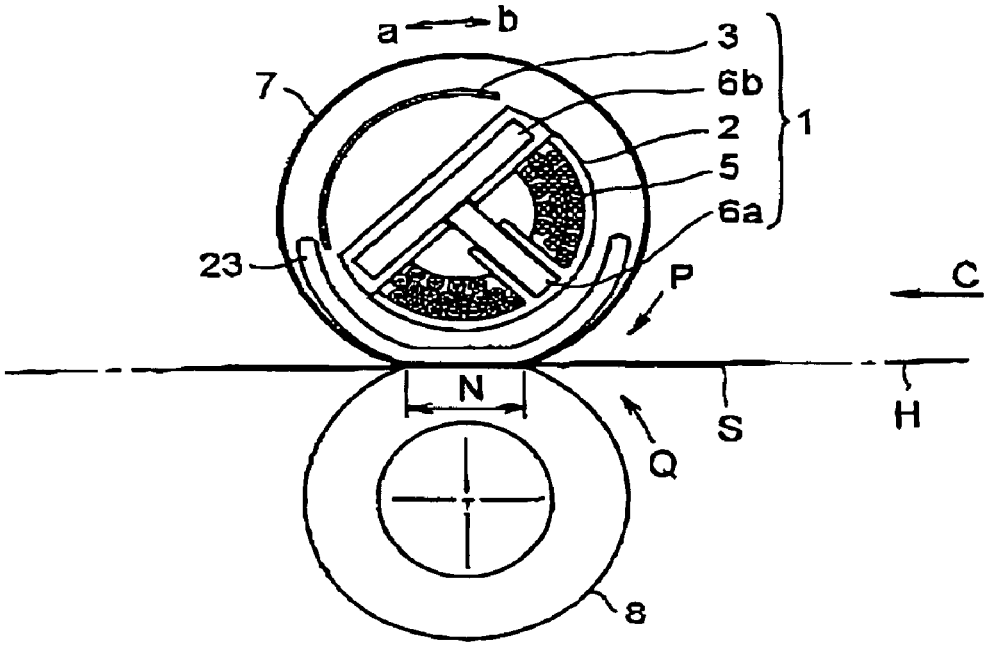
FIG. 14 is a schematic sectional view of the fixing apparatus in the sixth embodiment of the present invention, parallel to the diameter direction of the fixation roller, showing the general structure thereof.

FIG. 14 is a schematic sectional view of the fixing apparatus in the sixth embodiment of the present invention, showing the general structure thereof. FIG. 15 is a schematic sectional view of the fixing apparatus in the sixth embodiment and magnetic circuit, depicting the functions and movements of the magnetic flux blocking member in the sixth embodiment.

The fixing apparatus in the sixth embodiment essentially comprises: a magnetic flux adjustable heating assembly 1, a fixation film 7, a semicylindrical film guiding member 23, and a pressure roller 8 as a rotational pressuring member. The structure of the magnetic flux adjustable heating assembly 1 is the same as that in the first embodiment, except that instead of a fixation roller 7, a fixation film similar to a fixation film in accordance with the prior art, is employed as an inductive heating member.

A cylindrical (seamless) fixation film 7 as an inductive heat generating member, is loosely fitted around a semicylindrical film guiding member 23. The magnetic flux adjustable heating assembly 1 in this embodiment is structured so that the magnetic flux blocking member 3 can be moved into the gap between the magnetic flux adjustable heating assembly 1 and semicylindrical film guiding member 23 as is the magnetic flux adjustable heating assembly 1 in the first embodiment is structured so that the magnetic flux blocking member 3 can be moved into the gap between the magnetic flux generating means (combination of coil 5 and core 6) and the fixation roller 7.

The fixation nip (heating nip) N having a predetermined width is formed between the cylindrical film guiding member 23 and pressure roller 8, by placing the magnetic flux adjustable heating assembly 1 into the unshown housing of the fixing apparatus so that the semicylindrical film guiding member 23 is kept vertically pressed on the pressure roller 8 from above. In this fixation nip N, the internal surface of the fixation film 7 is kept in contact with the downwardly facing surface of the semicylindrical film guiding member 23.

The pressure roller 8 is rotationally driven in the direction indicated by an arrow mark B by an unshown driving means. As the pressure roller 8 is driven, the fixation film 7 is rotated by the friction between the peripheral surface of the pressure roller 8 and the external surface of the fixation film 7, in the fixation nip N. As a result, the fixation film 7 rotates in the direction indicated by arrow mark A, around the semicylindrical film guiding member 23, with the internal surface of the fixation film 7 sliding on the downwardly facing surface of the semicylindrical film guiding member 23.

The coil 5 is made to generate alternating magnetic flux, by the alternating current supplied to the coil 5 from an unshown excitation circuit. The alternating magnetic flux is guided by the core 6 to the fixation nip N, inducing eddy current in the electromagnetic induction heat generation layer of the fixation film 7, in the fixation nip N. The electromagnetic induction heat generation layer of the fixation film 7 will be described later. The eddy current generates Joule heat in the electromagnetic induction heat generation layer of the fixation film 7 because of the resistivity of the layer. In other words, as the coil 5 is supplied with alternating current, heat is generated by electromagnetic induction, in the fixation film 7, in the fixation nip N.

The principle of the electromagnetic induction heating, and the method for image fixation, in this embodiment which employs the fixation film 7, are the same as those in the first embodiment.

In the sixth embodiment which employs the fixation film 7, as a recording medium S passes through the fixation nip N, the recording medium S separates from the external surface of the fixation film 7 because of the curvature of the semicylindrical film guiding member 23, on the exit side of the fixation nip N. Therefore, separation claws such as those required when the fixation roller is employed are not necessary.

The semicylindrical film guiding member 23 is an electrically insulating and heat resistant member which does not prevent the magnetic flux from going through the member, and guides the cylindrical fixation film 7, by the internal surface of the fixation film 7, while the fixation film 7 rotates around the semicylindrical film guiding member 23, playing the role of stabilising the rotation of the fixation film 7.

The fixation film 7 in the sixth embodiment is the same as a fixation film in accordance with the prior art. That is, it is a multilayer film comprising three layers: an electromagnetic induction heat generation layer, or the most inward layer (layer on the film guiding member 23 side); an elastic layer, or the layer on the outward side of the heat generation layer; and a release layer, or the outermost layer (surface layer, or layer on pressure roller 8 side).

The arcuate magnetic flux blocking member 3 is rotatable in the direction indicated by an arrow mark a or b, through the gap between the semicylindrical film guiding member 23 and the magnetic flux generating means (combination of coil 5 and core 6). The role of the magnetic flux blocking member 3 in this embodiment is the same as those in the other embodiments in that it prevents or minimize the excessive temperature increase in the portions of the fixation nip N outside the recording medium track, by reducing the density of the effective alternating magnetic flux in the portions of the fixation nip N outside the recording medium track, compared to that in the portion of the fixation nip N inside the recording medium track, when recording mediums, the width of which is such a width that causes the excessive temperature increases, is used.

Figure 15:
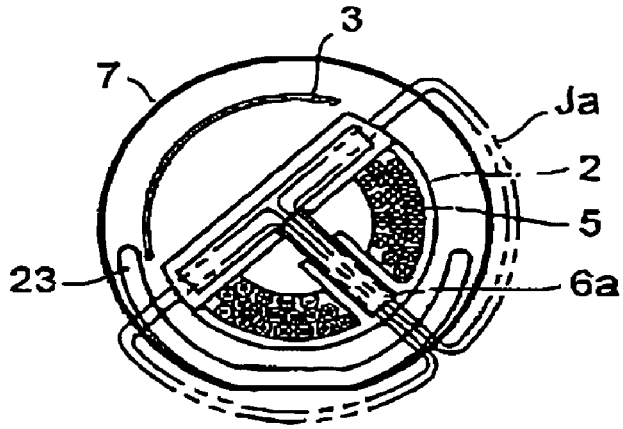
FIG. 15 is a schematic drawing showing the magnetic circuit when the magnetic flux is blocked by the magnetic flux blocking member in the fixing apparatus in the sixth embodiment of the present invention.
Figure 15:
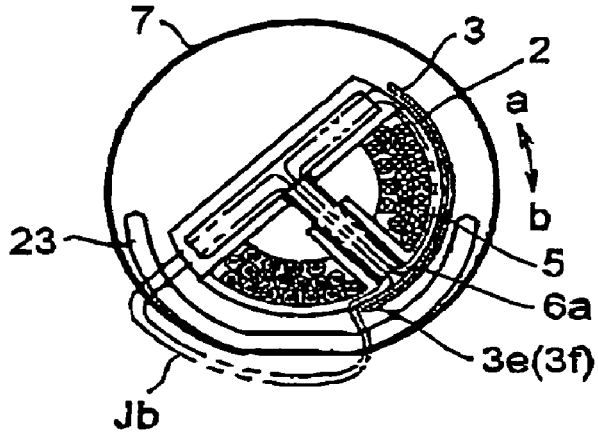
Figure 15:
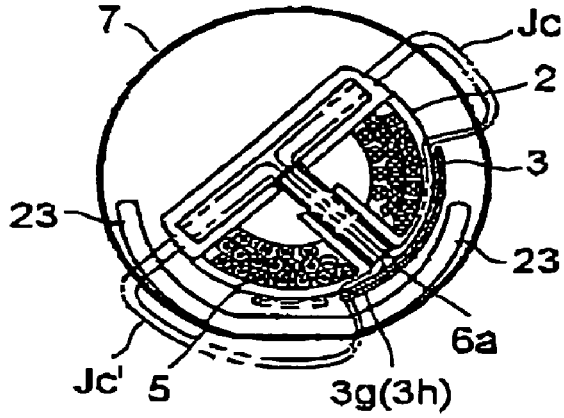

FIG. 15 is a schematic sectional view of the fixing apparatus and the effective magnetic circuit in the sixth embodiment of the present invention. The changes in the magnetic circuit caused by the magnetic flux blocking member 3, that is, the flow of the magnetic flux when the portion 6*a* of the core 6 is partially covered with the shielding portions of the magnetic flux blocking member 3, are the same as those in the first embodiment, and are as follows.

FIG. 15(*a*) shown the magnetic circuit formed when recording medium with the width A which does not cause the excessive temperature increase in the portions of the fixation nip N outside the recording medium track is used. The magnetic flux blocking member 3 is on standby in the position in which it does not affect the magnetic circuit Ja. When the magnetic flux blocking member 3 is in this standby position, fixation is possible across the entirety of the fixation nip N, the dimension of the effective range of which virtually matches the width A of the recording medium.

When the recording medium with the width B which causes the excessive temperature increases in the fixation nip outside the recording medium track, is used, the magnetic flux blocking member 3 is rotated into the magnetic circuit, as shown in FIG. 15(*b*), impeding the flow of the magnetic flux. Designated by referential symbol Jb in the drawing is the magnetic circuit when the magnetic flux is impeded by the fixation roller shielding portions 3*e* and 3*f*, by the width of Ba and Bb, respectively (FIG. 3). As will be evident from the drawing, the portions of the magnetic flux which go through the portions of the fixation roller 7 outside the recording medium track and shielded by the fixation roller shielding portions 3*e* and 3*f* having the widths of Ba and Bb, respectively, are smaller than that those shown in FIG. 15(*a*). Thus, the amount by which heat is generated in these portions of the fixation roller 7 by electromagnetic induction is smaller, and therefore, these portions of the fixation roller 7 do not excessively increase in temperature. In this case, the center portion of the fixation nip, the width of which equals the recording medium width B (range between the inward edges of the fixation roller shielding portions 3*e* and 3*f* perpendicular to the axial direction of the fixation roller 7) is where the fixation by electromagnetic induction is possible.

The operation of the magnetic flux adjustable heating assembly 1 when the recording medium with the width C, which causes the excessive temperature increase in the portions of the fixation nip outside the recording medium track, is used is similar to that when the recording medium with the width B is used. That is, the magnetic flux blocking member 3 is further rotated in order to cause the fixation roller shielding portions 3*g* and 3*h* of the magnetic flux blocking member 3 to face the primary portion 6*a* of the core 6, as shown in the drawing, so that the flow of the magnetic flux is impeded by the shielding portions 3*g* and 3*h*. The referential symbols Jc and Jc' designate the portions of the magnetic circuits, from the portions of the core 6 covered by the shielding portions 3*r* and 3*a* having the widths of Ca and Cb (FIG. 3). The referential symbols Jb, Jb', Jc, and Jc' in FIGS. 4(*b*) and 4(*c*) designate the portions of the magnetic flux which go through the portions of the fixation roller 7 outside the track of the recording medium with the width of C and shielded from the portion 6*a* of the core 6 by the combination of the shielding portions 3*e* and 3*g*, having a total width of (Ba+Ca), and the combination of the shielding portions 3*f* and 3*h*, having a total width of (Bb+Cb). As will be evident from the drawing, the portions of the magnetic flux which go through the fixation roller shielded from the primary portion 6*a* of the core 6 by the combination of the shielding portions 3*e* and 3*g*, having the width of (Ba+Ca), and the combination of the shielding portions 3*r* and 3*h*, having the width of (Bb+Cb), is smaller than that in FIG. 4(*a*). In other words, the amount by which heat is generated in these portions of the fixation roller 7, having the widths of (Ba+Ca) and (Bb+Cb), respectively, by electromagnetic induction is smaller, and therefore, these portions do not excessively increase in temperature. In this case, the center portion of the fixation nip, the width of which equals the recording medium width C (range between the inward edges of the fixation roller shielding portions 3*g* and 3*h* perpendicular to the axial direction of the fixation roller 7) is where the fixation by electromagnetic induction is possible.

EXAMPLE OF IMAGE FORMING APPARATUS

Figure 5:
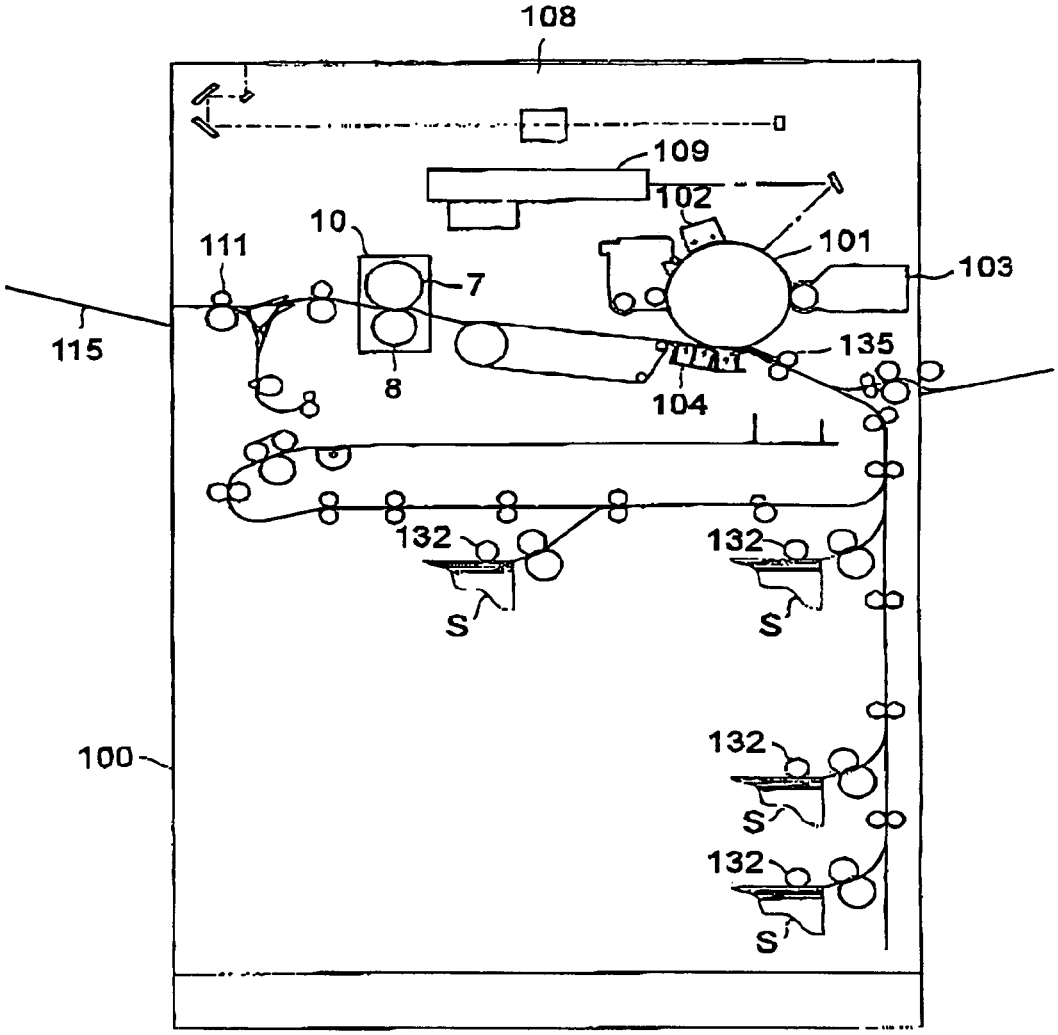
FIG. 5 is a schematic sectional view of a typical image forming apparatus employing the fixing apparatus in the first embodiment of the present invention, showing the general structure thereof.

The fixing apparatuses in the preceding embodiments are mounted in an electrophotographic image forming apparatus, for example. FIG. 5 is a schematic sectional view of an example of an image forming apparatus equipped with the fixing apparatus 10 in the first embodiment of the present invention, showing the general structure thereof.

The image forming operation of the image forming apparatus 100 is as follows. An original is read by the image reading portion 108, and an electrostatic latent image is formed on the peripheral surface of the photosensitive drum 101 by exposing the peripheral surface of the photosensitive drum 101 by the image writing portion 109, based on the data obtained by reading the original, in response to a command from a controller (unshown). More specifically, prior to the exposure of the peripheral surface of the photosensitive drum 101, the peripheral surface of the photosensitive drum 101 is uniformly charged to a predetermined potential level by the charging device 102, and a beam of laser light or the like is projected by the image writing portion 109, onto the uniformly charged peripheral surface of the photosensitive drum 101 to form an electrostatic latent image on the peripheral surface of the photosensitive drum 101. The latent image on the photosensitive drum 101 is developed into an image formed of toner (toner image), by the developing apparatus which employs toner. Then, the toner image on the peripheral surface of the photosensitive drum 101 is conveyed by the rotation of the photosensitive drum 101 to the contact area between the peripheral surface of the photosensitive drum 101 and the transferring member of the transferring apparatus 104.

In synchronism with the formation and conveyance of the toner image, recording mediums S are fed one by one into the main assembly of the image forming apparatus, by the pickup roller 132, and are conveyed to the contact area between the peripheral surface of the photosensitive drum 101 and the transferring member of the transferring apparatus 104. While the recording medium S is conveyed through the contact area, the toner image on the peripheral surface of the photosensitive drum 101 is transferred onto the recording medium S by the transferring apparatus 104.

After the transfer of the toner image onto the recording medium S, the recording medium S is conveyed by the conveying apparatus to the fixation roller 7, being pinched by the fixation roller 7 and pressure roller 8 while being heated by the heat electromagnetically induced in the fixation roller by the magnetic flux generating means disposed in the hollow of the fixation roller 7. As the result, the toner image on the recording medium S is welded to the recording medium S. Thereafter, the recording medium S bearing the fixed toner image is discharged by the pair of discharge rollers into the external delivery tray of the image forming apparatus, ending a single sequence of the image formation process.

In each of the fixing apparatuses in the preceding embodiments of the present invention, the magnetic flux generating means (combination of coil 5 and core 6) is held by the holder 2, and the magnetic flux blocking member 3 is rotated inside the hollow of the fixation roller (or film) 7, about the holder supporting portions (shafts 2*a* and 2*b*), or the lengthwise end portions of the holder 2. Therefore, the coil 5 of the magnetic flux generating means 9 does not come into contact with the magnetic flux blocking member 3, being thereby prevented from being damaged by the contact.

Further, the magnetic flux blocking member 3 is rotated about the holder supporting portions, or the lengthwise end portions of the holder. Therefore, the excessive temperature increase in the portions of the fixation nip outside the recording medium track can be prevented without affecting the fixation speed. Thus, the fixing apparatus in accordance with the present invention is superior in image formation productivity to a fixing apparatus in accordance with the prior art.

In particular, in the first to sixth embodiments, the magnetic flux generating means (combination of coil 5 and core 6), holder 2, and magnetic flux blocking member 3 are assembled into an integral unit, improving the fixing apparatus in assembly efficiency and service efficiency.

In the first, fifth, and sixth embodiments, the rotational axis of the magnetic flux blocking member 3 is made to coincide with the rotational axis of the fixation roller 7, eliminating the need for the space in which the magnetic flux blocking member is to be kept on standby, and the space in which the means for driving the magnetic flux blocking member is to be placed. Thus, these embodiments can reduce the size of a fixing apparatus.

In the fourth embodiment, the rotational axis of the holder, inclusive of the magnetic flux generating means (combination of coil 5 and core 6) is made to coincide with the rotational axis of the fixation roller 7, eliminating the need for the above described standby space and driving means space. Thus, the fourth embodiment can reduce the size of a fixing apparatus.

In the sixth embodiment, the magnetic flux blocking member 3 is rotated between the fixation pressure applying member (semicylindrical film guiding member 23) and the magnetic flux adjustable heating assembly 1. Therefore, the magnetic flux blocking member 3 does not rub against the fixation film 7. Therefore, the fixation film 7 is not damaged and/or deteriorated. Further, with no contact between the magnetic flux blocking member 3 and fixation film 7, the torque necessary for driving the magnetic flux blocking member in this embodiment is smaller than that required to drive the magnetic flux blocking member of a fixing apparatus in accordance with the prior art.

As described above, the present invention makes it possible to realize an induction heating type fixing apparatus which employs an magnetic flux blocking means, and yet is smaller in size, lower in cost, lower in power consumption, and higher in productivity, than a fixing apparatus in accordance with the prior art.

Miscellanies

Which type of the fixing apparatus among the fixing apparatuses in the preceding embodiments of the present invention is to be selected to be mounted in a given image forming apparatus is to be determined by the specifications of the image forming apparatus.

In this specification, the present invention is described with reference to three types of heating apparatus. However, the holder 2 in the fixing apparatus in the first or second embodiment may be positioned in the hollow of the fixation roller 7 so that the axial lines of the supporting shafts 1*a* and 2*b* of holder 2 do not coincide with the rotational axis 7*c* of the fixation roller 7. Such a modification does not change the effects of the present invention.

In each of the fixing apparatuses in the preceding embodiments, the holder 2 holding the magnetic flux generating means and the magnetic flux blocking member 3 are assembled into a compact unit, realizing an induction heating type fixing apparatus which employs a magnetic flux adjusting means, and yet is smaller in size, lower in cost, smaller in power consumption, and higher in productivity than a fixing apparatus in accordance with the prior art.

Each of the preceding embodiments was described with reference to a fixing apparatus employing a fixation roller as an induction heating member. However, the employment of a fixation film, similar to a fixation film in accordance with the prior art, as an induction heating member, does not affect the effects of the present invention.

Further, the present invention was described with reference to a magnetic flux blocking member as a magnetic flux adjusting member. However, the heat distribution in the fixation nip in terms of the lengthwise direction of a heating member may be changed by rotationally driving a magnetic core, instead of a magnetic flux blocking member, by a driving member.

Further, the present invention was described with reference to a magnetic flux adjusting means as a means driven by a rotational driving means. However, instead of a magnetic flux adjusting means, a means for supporting a coil may be driven by a rotational driving means. Such a modification does not affect the effects of the present invention.

The image forming method to be employed by an image forming apparatus employing the fixing apparatus in accordance with the present invention does not need to be limited to an electrophotographic image forming method. It may be an electrostatic recording method, a magnetic recording method, or the like. Further, it may be of a transfer type or a direct formation type.

The usage of the heating apparatus in accordance with the present invention is not limited to the usage as an image heating apparatus such as those in the preceding embodiments. That is, the heating apparatus in accordance with the present invention also can be used as various means or apparatuses for heating an object, for example, an image heating apparatus for heating a recording medium bearing an image, in order to improve the recording medium in the surface properties such as glossiness, an image heating apparatus for temporarily fixing an image, an heating apparatus for drying an object, a heating apparatus for lamination.

While the invention has been described with reference to the structures disclosed herein, it is not confined to the details set forth, and this application is intended to cover such modifications or changes as may come within the purposes of the improvements or the scope of the following claims.

What is claimed is:

1. A heating apparatus comprising:

a heat generation member for generating heat using magnetic flux;

a coil for generating the magnetic flux by electric power supply thereto, said coil being disposed in said heat generation member;

wherein a material to be heated is fed and introduced in a heating portion of said heat generation member to heat an image on the material to be heated by heat generated by said heat generation member;

a movable member which is movable in said heat generation member;

a rotatable drive transmission member for transmitting a driving force to said movable member, wherein said drive transmission member has a hollow rotation shaft, and a supply line for supplying the electric power is connected to said coil through the hollow rotation shaft;

magnetic flux adjusting means having a magnetic flux adjustment member for changing a density distribution of the magnetic flux actable on said heat generation member with respect to a direction perpendicular to a feeding direction of the material to be heated, wherein said magnetic flux adjusting means drives said drive transmission member to move said magnetic flux adjustment member to change the density distribution with respect to the direction perpendicular to the feeding direction, wherein said magnetic flux adjustment member includes a magnetic flux shield member for shielding a part of the magnetic flux, wherein said magnetic flux shield member has a shield portion corresponding to a width of the material to be heated, and said magnetic flux adjusting means drives said magnetic flux shield member corresponding to a width of the material to be heated to shield the magnetic flux at a non-feeding portion for the material to be heated; and a holding member for holding said coil, wherein each of opposite ends of said holding member with respect to a rotational axis of said heat generating member is provided with a supporting portion for supporting said holding member, and wherein at least one of said supporting portions has a hollow supporting portion for permitting the supply line to extend out, and wherein said drive transmission member is supported through said hollow supporting portion, and said supply line is extended out through said hollow supporting portion.

2. An apparatus according to claim 1, wherein said magnetic flux adjustment member is rotatably mounted on said holding member, and said holding member and magnetic flux adjustment member are unified into an assembly.

3. An apparatus according to claim 1, wherein said supply line is extended out at one end of said heat generating member with respect to the rotational axis, and an end of said supporting portion opposite said one end is tapered.

* * * * *

UNITED STATES PATENT AND TRADEMARK OFFICE

CERTIFICATE OF CORRECTION

PATENT NO. : 7,009,158 B2
APPLICATION NO. : 10/787079
DATED : March 7, 2006
INVENTOR(S) : Hajime Sekiguchi et al.

It is certified that error appears in the above-identified patent and that said Letters Patent is hereby corrected as shown below:

COLUMN 4:
Line 21, “comprising” should read --comprises--.

COLUMN 5:
Line 56, “1, com” should read --1 com--.

COLUMN 6:
Line 32, “or” should read --of--.

COLUMN 9:
Line 55, “bear” should read --gear--.

COLUMN 14:
Line 24, “or” should read --of--.

COLUMN 15:
Line 54, “bear 18).” should read --gear 18).--.

COLUMN 17:
Line 21, “servicing” should read --service--.

COLUMN 19:
Line 63, “corresponds” should read --corresponds to--.

COLUMN 20:
Line 12, “goes” should read --go--.
Line 16, “that” should read --that of--.

COLUMN 23:
Line 7, “minimize” should read --minimizes--.
Line 25, “shown” should read --shows--.
Line 49, “that” should read --that of--.

UNITED STATES PATENT AND TRADEMARK OFFICE

CERTIFICATE OF CORRECTION

PATENT NO. : 7,009,158 B2
APPLICATION NO. : 10/787079
DATED : March 7, 2006
INVENTOR(S) : Hajime Sekiguchi et al.

It is certified that error appears in the above-identified patent and that said Letters Patent is hereby corrected as shown below:

COLUMN 24:
Line 6, "3r and 3a" should read --3r and 3s--.
line 19, "3r and 3h," should read --3f and 3h,--.

Signed and Sealed this

Fifteenth Day of August, 2006

JON W. DUDAS
*Director of the United States Patent and Trademark Office*